United States Patent [19]

Okuyama et al.

[11] 4,216,692

[45] Aug. 12, 1980

[54] KEYBOARD TYPE AUTOMATIC ACCOMPANYING SYSTEM

[75] Inventors: Yasuhiko Okuyama; Koji Tanaka, both of Ora; Yoshiro Nakayama, Kumagaya; Hiroshi Kato, Ageo, all of Japan

[73] Assignee: Kabushiki Kaisha Kawai Gakki Seisakusho, Hamamatsu, Japan

[21] Appl. No.: 922,000

[22] Filed: Jul. 5, 1978

[30] Foreign Application Priority Data

| | | | |
|---|---|---|---|
| Jul. 6, 1977 | [JP] | Japan | 52-80860 |
| Jul. 14, 1977 | [JP] | Japan | 52-84546 |
| Jul. 20, 1977 | [JP] | Japan | 52-86878 |
| Sep. 5, 1977 | [JP] | Japan | 52-106391 |
| Sep. 7, 1977 | [JP] | Japan | 52-107352 |
| Sep. 9, 1977 | [JP] | Japan | 52-107980 |
| Sep. 14, 1977 | [JP] | Japan | 52-110882 |
| Oct. 12, 1977 | [JP] | Japan | 52-121537 |
| Oct. 14, 1977 | [JP] | Japan | 52-123193 |

[51] Int. Cl.[2] ..... G10H 1/00

[52] U.S. Cl. ..... 84/1.01; 84/1.03; 84/DIG. 22

[58] Field of Search ..... 84/1.01, 1.03, DIG. 22, 84/1.17

[56] References Cited

U.S. PATENT DOCUMENTS

| | | | |
|---|---|---|---|
| 3,624,263 | 11/1971 | Uchiyama | 84/1.03 |
| 3,951,028 | 4/1976 | Robinson | 84/1.03 |
| 3,990,339 | 11/1976 | Robinson | 84/1.03 |
| 4,019,417 | 4/1977 | Carlson | 84/1.03 |
| 4,108,037 | 8/1978 | Robinson | 84/1.03 |
| 4,142,433 | 3/1979 | Gross | 84/1.03 |
| 4,144,788 | 3/1979 | Bione | 84/1.03 |

*Primary Examiner*—J. V. Truhe
*Assistant Examiner*—William L. Feeney
*Attorney, Agent, or Firm*—Fleit & Jacobson

[57] ABSTRACT

A keyboard type automatic accompanying system wherein information representative of the root note of a chord and the type thereof are detected from key depression signals assigned by depressing a plurality of desired keys of an accompanying keyboard, the detected information are stored, and an automatic chord complying with the particular chord are accompanied. A chord detector comprises in combination a shift register which stores the accompanying key assignment signals therein and which shifts the stored contents cyclically, and a ROM device in which binary information indicative of the basic forms of chord names and the types of chords are stored. Outputs of the shift register are applied to the ROM device, and the type and the root note of the chord are detected in one shift cycle of the shift register, so that the circuit arrangement is simplified, that the detecting time is shortened and that the key response rate is enhanced. On the basis of the information representative of the root note of the chord and the type thereof, an auto-chord tone assignment signal is formed by an ACC signal generator. The signal is timed in a chord tone generator by a rhythm pulse transmitted from a rhythm pulse generator, and becomes an automatic chord accompanying tone signal. The tone signal is amplified by an amplifier and provided as an output by a loudspeaker.

18 Claims, 32 Drawing Figures

D KEY DEPRESSION 40
75
VDD
PRIME
MINOR THIRD
MAJOR THIRD
DIMINISH FIFTH
PERFECT FIFTH
MINOR SIXTH
MAJOR SIXTH
MINOR SEVENTH
Acc
81h
81g
81f
81e
81d
81c
81b
81a
n8
n4
n2
n1
77d
77c
77b
77a
78
79
80
76b
76
82f
82e
82d
82c
82b
82a
76a
ER
Aug
Dim
7th
3
M
ACD-P
T012
τ5+...+τ8

KEYBOARD TYPE AUTOMATIC ACCOMPANYING SYSTEM

BACKGROUND OF THE INVENTION

This invention relates to automatic accompanying apparatus in which the automatic accompaniment of a bass tone or chord tone complying with a chord name assigned by depressing a plurality of desired keys of an accompanying keyboard is effected. More particularly, it relates to a keyboard type automatic accompanying system which has a chord detector comprising a shift register and a read only memory (ROM) device in combination.

An automatic accompanying system of the type having a keyboard generates a chord tone or bass tone corresponding to a key depression state in such a way that key depression signals produced by the depression of a plurality of keys on an accompanying keyboard and the assignment of a chord name (such as C major and D minor) by a performer are processed in electronic circuitry. Such an automatic accompanying apparatus requires a chord detector which detects the chord name defined by the depressed accompanying keys.

In this respect, the number of key depression states which are assigned by the performer is very large. As the number of chord types to be detected increases, the circuit arrangement inevitably becomes complicated. Even when the number of chord types to be detected is constant, the degree of complexity of the circuit arrangement varies greatly depending on what chord detection system is adopted.

For these reasons, there is employed a chord detector for which the number of chord types to be detected is made as small as possible and which detects only principal chords of high frequency of use as are musically important, for example, only major, minor, seventh etc. From the side of the performer, however, a smooth performance needs to be made even in case where any chord other than the principal chords has been assigned.

Further, apparatus of still higher grades have such various functions that a chord and a bass tone are automatically played in rhythmic accompaniment merely by depressing a single key on an accompanying keyboard and that an automatic accompaniment is effected by a chord played on an accompanying keyboard and a bass tone adequate thereto.

Although a variety of chord detection systems have heretofore been proposed, they are not always fully satisfactory from the viewpoints of simplification of the circuit arrangement, adaptability to the form of an LSI, various requests in performance from the side of a performer, etc.

SUMMARY OF THE INVENTION

It is therefore an object of this invention to provide a keyboard type automatic accompanying system in which information representative of the root note of a chord and the type thereof are detected from key depression signals assigned by depressing a plurality of desired keys of an accompanying keyboard, the detected information are stored, and an automatic accompaniment complying with the particular chord can be played.

Another object of this invention is to provide an automatic accompanying apparatus which has a chord detector comprising in combination a shift register for storing key depression signals of accompanying keys and cyclically shifting the stored contents, and a ROM device storing therein binary information indicative of the basic forms of chord names and the types of chords.

Still another object of this invention is to provide an automatic accompanying apparatus which has a chord detector capable of storing many types of chords by the use of a ROM of small memory capacity.

A further object of this invention is to provide an automatic accompanying apparatus in which, even in case where an undetectable chord has been assigned, an automatic bass accompaniment consistent with the chord can be effected.

A further object of this invention is to provide an automatic accompanying apparatus in which, even when a plurality of keys have been erroneously depressed in case of the one-finger chord playing mode, a smooth automatic accompaniment can be effected.

A yet further object of this invention is to provide an automatic accompanying apparatus in which, even if when a plurality of keys are to be depressed or released they are not actuated perfectly simultaneously, a musically correct accompaniment can be effected.

Briefly, in the present invention, there is provided a keyboard type automatic accompanying system comprising accompanying keyboard means for providing key depression signals corresponding to notes of depressed keys, root note/chord detection means including in combination a shift register for storing said key depression signals and cyclically shifting the stored contents, and a read only memory device storing therein basic forms of chord names and types of chords, parallel outputs of said shift register being applied to said read only memory device so as to detect a root note of a chord to-be-played and a type thereof, tone signal producing means for generating a tone signal from the detected signal indicative of the root note or indicative of the root note as well as the chord type, and output means for amplifying said tone signal and driving a loudspeaker.

Other objects and features of the present invention will become apparent from the detailed description of preferred embodiments thereof, which will be read with the accompanying drawings.

pression signals are controlled by time division, that is, automatic accompanying apparatus wherein parallel signals of timings corresponding to respective notes of a keyboard are generated, they are transmitted to respective key switches of the keyboard, tone assignment signals are designated by key depression operations, they are converted into serial timing signals through an OR circuit, and the serial timing signals are transmitted to means for detecting a chord. Such an apparatus will therefore be described hereunder.

Figure 1:
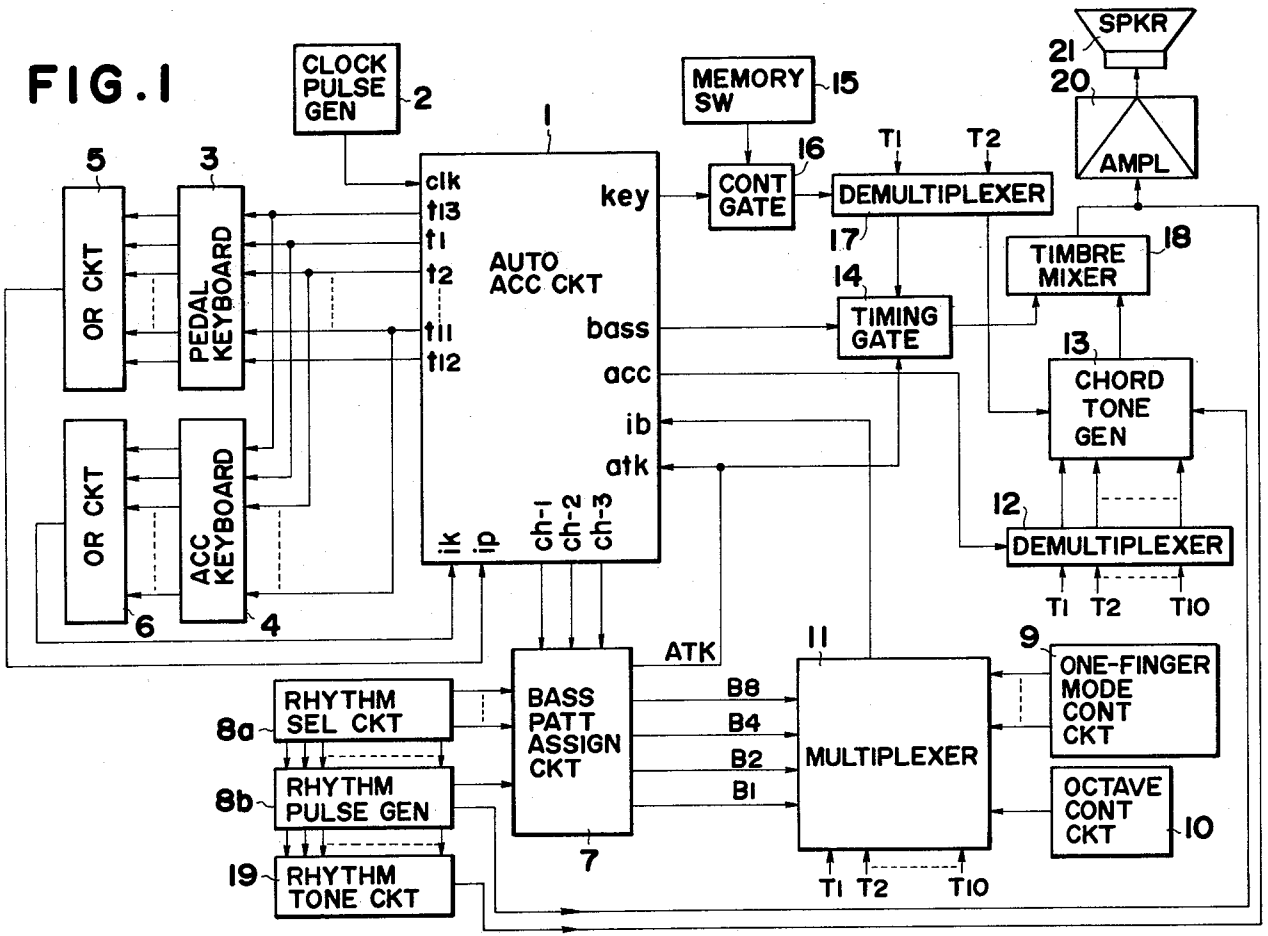
FIG. 1 is a block diagram which shows a preferred embodiment of an automatic accompanying apparatus according to this invention.
Figure 2:
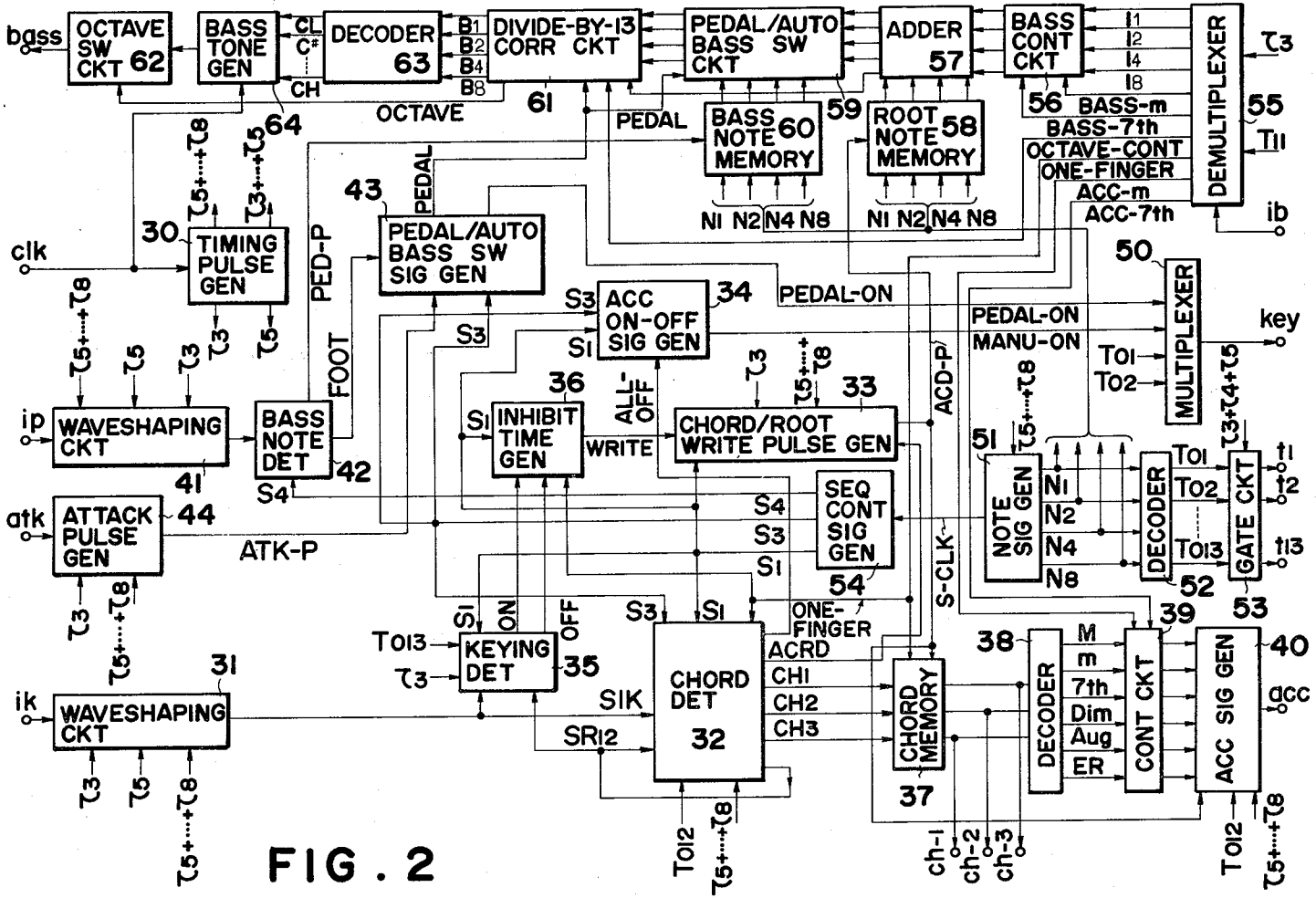
FIG. 2 shows a block diagram of an automatic accompanying circuit in the apparatus of FIG. 1.
Figure 3:
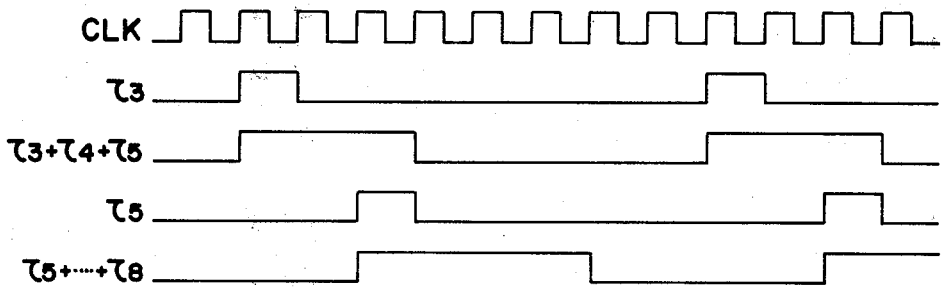
FIG. 3 is a timing diagram which shows output signals of a clock pulse and timing pulse generator circuit.
Figure 4:
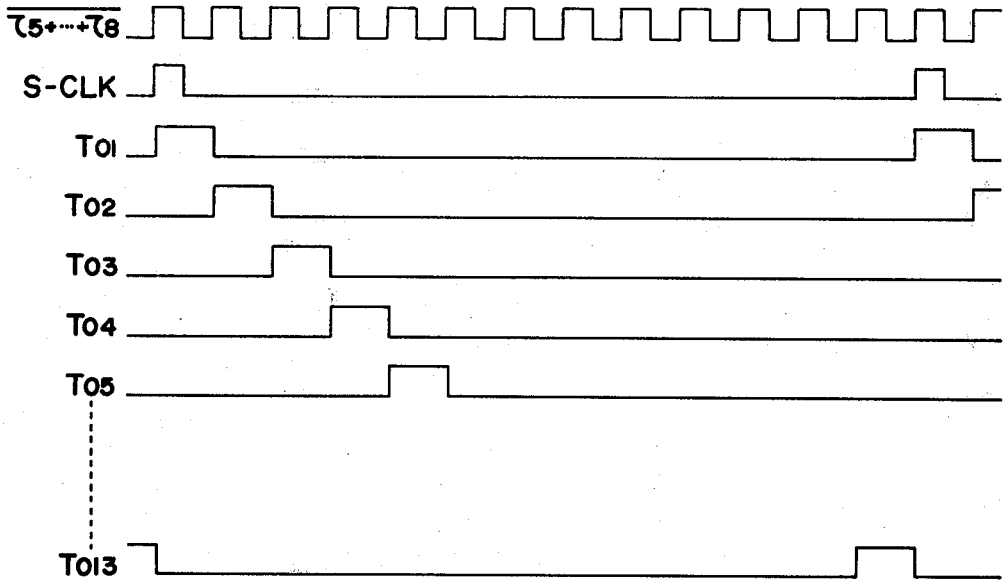
FIG. 4 is a timing diagram which shows output signals of a decoder for decoding binary information representative of notes, together with parts of input and output signals of a note signal generator.
Figure 5:
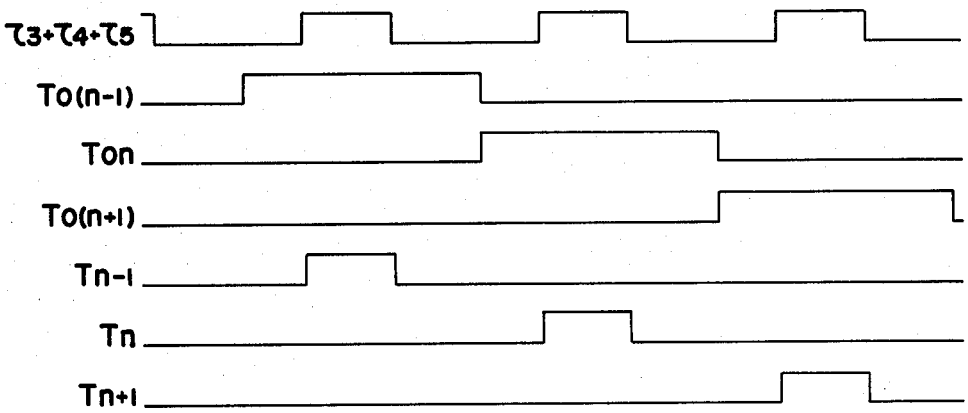
FIG. 5 is a timing diagram of input and output signals of a gate circuit of waveshaping the outputs of the decoder.

I. Outline of Automatic Accompanying Equipment:

In order to facilitate understanding, the schematic consturction of the automatic accompanying equipment and the operation thereof will be explained. As shown in FIG. 1, the automatic accompanying equipment is constructed such that keyboard portions, peripheral circuits etc. are connected around and to an automatic accompanying circuit 1 which is put into the form of a perfect LSI (large-scale integrated circuit). The automatic accompanying circuit 1 is illustrated in FIG. 2, and will be described later. A clock pulse generator 2 generates clock pulses CLK at a fixed frequency (FIG. 3), and supplies them to the automatic accompanying circuit 1. By utilizing the clock pulses CLK the automatic accompanying circuit 1 carries out various signal processing and makes thirteen sorts of parallel signals $T_1$, $T_2$. . . , $T_{13}$ different in timing from one another (referto FIGS. 4 and 5), which are respectively delivered from output terminals $t_1$, $t_2$ . . . , $t_{13}$. Such parallel timing signals $T_1$, $T_2$ . . . , $T_{13}$ are respectively supplied to a pedal keyboard 3 as well as an accompanying keyboard 4, provided that the output terminal $t_{12}$ is connected with the pedal keyboard 3 but not with the accompanying keyboard 4.

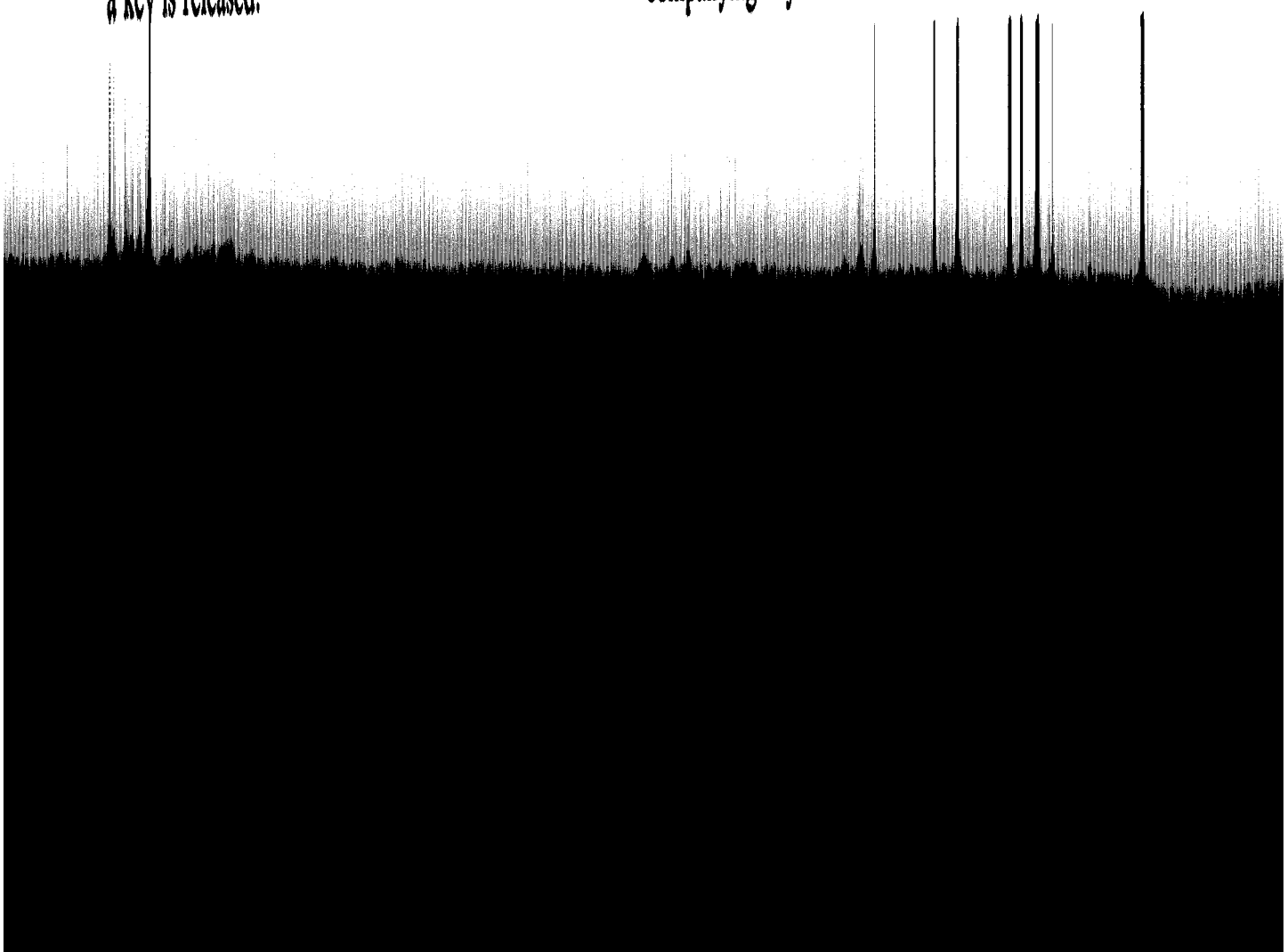

Table 3-1

| Chord | Output ch-1 | ch-2 | ch-3 |
|---|---|---|---|
| major (M) | 0 | 0 | 0 |
| minor (m) | 1 | 0 | 0 |
| seventh (7th) | 0 | 1 | 0 |
| augment (Aug) | 1 | 1 | 0 |
| diminish (Dim) | 0 | 1 | 1 |
| erroneous key depression (ER) | 1 | 1 | 1 |

Table 3-2

| Chord | Accompanying Key C | C# | D | D# | E | F | F# | G | G# | A | A# | B |
|---|---|---|---|---|---|---|---|---|---|---|---|---|
| major (M) | 1 | | | | | | | | | | | |
| | 1 | | | | 1 | | | | | | | |
| | 1 | | | | | | | 1 | | | | |
| | 1 | | | | 1 | | | 1 | | | | |
| | 1 | | | | 1 | | | 1 | | 1 | | |
| | 1 | | | | 1 | | | 1 | | | | 1 |
| minor (m) | 1 | | | 1 | | | | | | | | |
| | 1 | | | 1 | | | | 1 | | | | |
| | 1 | | | 1 | | | | | | | 1 | |
| | 1 | | | 1 | | | | 1 | | 1 | | |
| | 1 | | | 1 | | | | 1 | | | | 1 |
| seventh (7th) | 1 | | | | 1 | | | | | | 1 | |
| | 1 | | | | 1 | | | 1 | | | 1 | |
| augment (Aug) | 1 | | | | 1 | | | | 1 | | | |
| diminish (Dim) | 1 | | | 1 | | | 1 | | | | | |
| | 1 | | | 1 | | | 1 | | | 1 | | |

Here, symbol "1" denotes a depressed key state, and blank a released key state. Any accompanying key-designated signal $I_K$ other than those in Table 3-2 corresponds to the erroneous key depression ER.

The chord type-assigning signal is supplied to a bass pattern assignment circuit 7 along with a rhythm assigning signal generated by a rhythm selector 8*a*. Thus, stored information which correspond to the kind of rhythm (such as waltz and rhumba) and the type of chord (such as major and minor) are selected. The stored information, i.e., 4-bit binary degree signal for assigning a bass pattern for automatic bass accompaniment is read out in accordance with timing signals generated from a rhythm pulse generator 8*b*. An example is given in Table 4.

Table 4

| Chord assignment | Stored Signal $B_8$ | $B_4$ | $B_2$ | $B_1$ | Degree |
|---|---|---|---|---|---|
| | MSB | | | LSB | |
| | 0 | 0 | 0 | 0 | prime |
| | 0 | 1 | 0 | 0 | major third |
| | 0 | 1 | 1 | 1 | perfect fifth |
| major | 1 | 0 | 0 | 1 | major sixth |
| | 1 | 0 | 1 | 0 | minor seventh |
| | 1 | 0 | 0 | 1 | major sixth |
| | 0 | 1 | 1 | 1 | perfect fifth |
| | 0 | 1 | 0 | 0 | major third |

Besides, the bass pattern assignment circuit 7 generates an attack signal ATK for switching the playing to auto-bass accompaniment in which a bass tone corresponding to the chord is automatically generated. A 4-bit degree signal $B_1$, $B_2$, $B_4$, $B_8$ which is transmitted from the bass pattern assignment circuit 7 and which assigns the subtonic of the auto-bass note, various control signals from a one-finger mode control circuit 9 being used when the electronic musical instrument executes the automatic accompaniment in a one-finger chord playing mode, and a control signal which is delivered from an octave control circuit 10 and which controls the octave of the bass tone output are respectively applied to a multiplexer 11, in which they are converted into time-divided signals with the timing signals $T_1, T_2 \ldots, T_{10}$. The time-divided signals are applied to a terminal ib of the automatic accompanying circuit 1 by a single control line. Here, the degree signals $B_1$, $B_2$, $B_4$, $B_8$ are 4-bit binary serial timing signals and are allotted as indicated in Table 5.

Table 5

| Timing | Degree 1° | minor 2° | major 2° | minor 3° | major 3° | perf. 4° | dim. 5° | perf. 5° | minor 6° | major 6° | minor 7° | major 7° |
|---|---|---|---|---|---|---|---|---|---|---|---|---|
| $T_7$(MSB) | | | | | | | | | 1 | 1 | 1 | 1 |
| $T_8$ | | | | | 1 | 1 | 1 | 1 | | | | |
| $T_9$ | | | 1 | 1 | | | 1 | 1 | | | 1 | 1 |
| $T_{10}$(*LSB*) | | 1 | | 1 | | 1 | | 1 | | 1 | | 1 |

Further applied to the terminal ib are a signal for the switching (major→minor) or (major→seventh) of an auto-bass tone to be described later, a signal for the switching (major→minor) or (major→seventh) of an auto-chord note assigning signal ACC to be also described later, and an octave signal.

Figure 6:
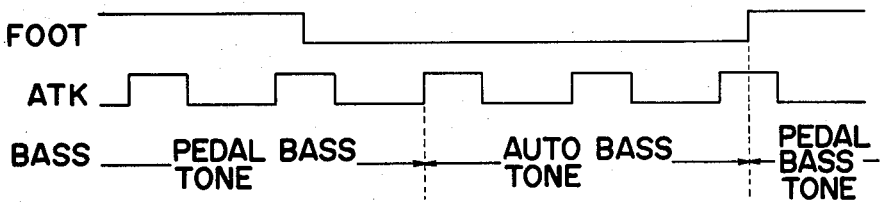
FIG. 6 is a timing diagram which illustrates the operation of a pedal/auto-bass switching signal generator circuit.

A terminal 'bass' of the automatic accompanying circuit 1 provides therefrom an auto-bass tone signal or a bass tone signal of the note assigned by the pedal-designated signal $I_P$. The switching between the pedal bass tone signal and the auto-bass tone signal is effected by the attack signal ATK. In case where the pedal is preferential and where a FOOT signal does not exist, the switching to the auto-bass tone is done in synchronism with the leading edge of the attack signal ATK as illustrated in FIG. 6. In case where a plurality of pedals have been simultaneously depressed, the bass tone of the lowest note is delivered.

Figure 7:
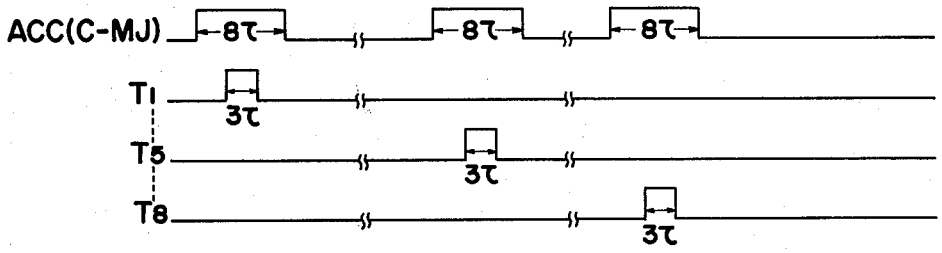
FIG. 7 is a timing diagram which illustrates the relations between an ACC signal and timing signals.

The auto-bass tone is a note output obtained in such a way that an auto-bass note assignment signal $I_B$ applied to the terminal ib and the root note of a detected chord are added, whereupon the sum is subjected to a divide-by-13 correction. From a terminal 'acc' of the automatic accompanying circuit 1, the auto-chord note assignment signals ACC for auto-chord accompaniment are delivered as serial timing signals. The truth table of the ACC signals is as indicated in Table 6-1, Table 6-2 and Table 6-3. Table 6-1 corresponds to the major chord and the erroneous key depression, Table 6-2 the diminish chord, and Table 6-3 the minor, seventh and augment chords, Numeral "1" denotes a high level, and blank a low level. FIG. 7 illustrates the relations between the auto-chord note assignment signal ACC and the timing signals $T_1, \ldots, T_{13}$ in the case of the C major chord.

Table 6-1

| Chord | Root note | ACC $T_1$ | $T_2$ | $T_3$ | $T_4$ | $T_5$ | $T_6$ | $T_7$ | $T_8$ | $T_9$ | $T_{11}$ | $T_{12}$ | $T_{13}$ | |
|---|---|---|---|---|---|---|---|---|---|---|---|---|---|---|
| | C | 1 | | | | 1 | | | 1 | | | | | |
| | C# | | 1 | | | | 1 | | | 1 | | | | |
| | D | | | 1 | | | | 1 | | | 1 | | | |
| Major | D# | | | | 1 | | | | 1 | | | 1 | | |
| | E | | | | | 1 | | | | 1 | | | 1 | 1 |
| & | F | 1 | | | | | 1 | | | | 1 | | | |
| | F# | | 1 | | | | | 1 | | | | 1 | | |
| | G | | | 1 | | | | | 1 | | | | 1 | 1 |
| Erroneous | G# | 1 | | | 1 | | | | | 1 | | | | |
| key depression | A | | 1 | | | 1 | | | | | 1 | | | |
| | A# | | | 1 | | | 1 | | | | | 1 | | |
| | B | | | | 1 | | | 1 | | | | | 1 | 1 |
| Note assignment | | C | C# | D | D# | E | F | F# | G | G# | A | A# | | B |

Table 6-2

| Chord | Root note | ACC $T_1$ | $T_2$ | $T_3$ | $T_4$ | $T_5$ | $T_6$ | $T_7$ | $T_8$ | $T_9$ | $T_{10}$ | $T_{11}$ | $T_{12}$ | $T_{13}$ |
|---|---|---|---|---|---|---|---|---|---|---|---|---|---|---|
| | C | 1 | | | 1 | | | 1 | | | 1 | | | |
| | C# | | 1 | | | 1 | | | 1 | | | 1 | | |
| | D | | | 1 | | | 1 | | | 1 | | | 1 | 1 |
| | D# | 1 | | | 1 | | | 1 | | | 1 | | | |
| | E | | 1 | | | 1 | | | 1 | | | 1 | | |
| Diminish | F | | | 1 | | | 1 | | | 1 | | | 1 | 1 |
| | F# | 1 | | | 1 | | | 1 | | | 1 | | | |
| | G | | 1 | | | 1 | | | 1 | | | 1 | | |
| | G# | | | 1 | | | 1 | | | 1 | | | 1 | 1 |
| | A | 1 | | | 1 | | | 1 | | | 1 | | | |
| | A# | | 1 | | | 1 | | | 1 | | | 1 | | |
| | B | | | 1 | | | 1 | | | 1 | | | 1 | 1 |
| Note assignment | | C | C# | D | D# | E | F | F# | G | G# | A | A# | | B |

Table 6-3

| Chord | Root note | ACC $T_1$ | $T_2$ | $T_3$ | $T_4$ | $T_5$ | $T_6$ | $T_7$ | $T_8$ | $T_9$ | $T_{10}$ | $T_{11}$ | $T_{12}$ | $T_{13}$ |
|---|---|---|---|---|---|---|---|---|---|---|---|---|---|---|
| Minor | C | 1 | | | 1 | | | | 1 | | | | | |
| | C# | | 1 | | | 1 | | | | 1 | | | | |
| | D | | | 1 | | | 1 | | | | 1 | | | |
| | D# | | | | 1 | | | 1 | | | | 1 | | |
| | E | | | | | 1 | | | 1 | | | | 1 | 1 |
| | F | 1 | | | | | 1 | | | 1 | | | | |
| | F# | | 1 | | | | | 1 | | | 1 | | | |
| | G | | | 1 | | | | | 1 | | | 1 | | |
| | G# | | | | 1 | | | | | 1 | | | 1 | 1 |
| | A | 1 | | | | 1 | | | | | 1 | | | |
| | A# | | 1 | | | | 1 | | | | | 1 | | |
| | B | | | 1 | | | | 1 | | | | | 1 | 1 |
| Seventh | C | 1 | | | | 1 | | | 1 | | | 1 | | |
| | C# | | 1 | | | | 1 | | | 1 | | | 1 | 1 |
| | D | 1 | | 1 | | | | 1 | | | 1 | | | |
| | D# | | 1 | | 1 | | | | 1 | | | 1 | | |
| | E | | | 1 | | 1 | | | | 1 | | | 1 | 1 |
| | F | 1 | | | 1 | | 1 | | | | 1 | | | |
| | F# | | 1 | | | 1 | | 1 | | | | 1 | | |
| | G | | | 1 | | | 1 | | 1 | | | | 1 | 1 |
| | G# | 1 | | | 1 | | | 1 | | 1 | | | | |
| | A | | 1 | | | 1 | | | 1 | | 1 | | | |
| | A# | | | 1 | | | 1 | | | 1 | | 1 | | |
| | B | | | | 1 | | | 1 | | | 1 | | 1 | 1 |
| Augment | C | 1 | | | | 1 | | | 1 | | | | | |
| | C# | | 1 | | | | 1 | | | | 1 | | | |
| | D | | | 1 | | | | 1 | | | | 1 | | |

Table 6-3-continued

| Chord | Root note | ACC $T_1$ | $T_2$ | $T_3$ | $T_4$ | $T_5$ | $T_6$ | $T_7$ | $T_8$ | $T_9$ | $T_{10}$ | $T_{11}$ | $T_{12}$ | $T_{13}$ |
|---|---|---|---|---|---|---|---|---|---|---|---|---|---|---|
| | D# | | | | 1 | | | | 1 | | | | 1 | 1 |
| | E | 1 | | | | 1 | | | | 1 | | | | |
| | F | | 1 | | | | 1 | | | | 1 | | | |
| | F# | | | 1 | | | | 1 | | | | 1 | | |
| | G | | | | 1 | | | | 1 | | | | 1 | 1 |
| | G# | 1 | | | | 1 | | | | 1 | | | | |
| | A | | 1 | | | | 1 | | | | 1 | | | |
| | A# | | | 1 | | | | 1 | | | | 1 | | |
| | B | | | | 1 | | | | 1 | | | | 1 | 1 |
| Note assignment | | C | C# | D | D# | E | F | F# | G | G# | A | A# | B | |

Such auto-chord note assignment signals are supplied to a demultiplexer 12, in which they are timed by the timing signals $T_1 \ldots, T_{12}$ and are converted into parallel d. c. signals for assigning twelve auto-chord tones (C, C#, . . . , B). The parallel d.c. signals are sent to a chord tone generator 13, to generate the auto-chord tone assigned by the auto-chord note signal. The auto-chord tone is timed by the rhythm timing signal transmitted from the rhythm pulse generator **8*b***, and becomes an automatic chord accompanying tone.

The signal BASS from the 'bass' terminal has, in a timing gate circuit 14, its rhythm timing established by the ATK signal transmitted from the bass pattern assignment circuit 7. A memory switch circuit 15 is a circuit for controlling a memory operation, i.e., an operation in which the automatic accompaniment is continued even when the accompanying key is released and in which the assigned bass tone is sustained and delivered even when the pedal is released. A signal of the memory switch circuit 15 controls the passage through a control gate circuit 16, of a signal KEY transmitted from a terminal 'key'. The KEY signal consists of the serial timing signals $T_{01}$, $T_{01}$ indicative of whether the accompanying key and the pedal are in the depressed state or in the released state. Numeral 17 indicates a demultiplexer. A timbre mixer 18 forms the timbre of the chord tone signal as well as the BASS signal. The timbre signal is supplied to an amplifier 20 together with a rhythm signal of a rhythm tone circuit 19. A loudspeaker 21 is driven by an output of the amplifier 20.

II. Construction and Operation of Automatic Accompanying Circuit:

Referring to the circuit diagram of FIG. 2, there will be explained how output signals are formed and delivered in response to various input signals supplied to the automatic accompanying circuit 1. It is a timing pulse generator 30 that converts the clock pulses from the clock pulse generator 2 into various timing pulses $\tau_3$, $\tau_5$, $\tau_3+\tau_4+\tau_5$, $\tau_5+ \ldots + \tau_8$ (refer to FIG. 3) within the automatic accompanying circuit 1. These timing pulses are supplied to various circuits. The accompanying key assignment signal $I_K$ is waveshaped by a timing signal waveshaping circuit 31 and then sent to a chord detector 32. As previously stated, the chord detector 32 detects the 3-bit binary chord signal CH1, CH2, CH3 and sends and stores it into a chord memory 37. Simultaneously, the chord detector 32 generates a chord coincidence pulse signal ACRD and sends it to a chord/root note write-in pulse generator 33. Besides, it transmits to an accompanying key ON-OFF signal detector circuit 34 an ALL-OFF signal for detecting that none of the accompanying keys is depressed. A re-depression of the accompanying keyboard is detected by a keying detector 35, and the detection output is used to control an inhibit time generator 36. Thus, at the key change at which the accompanying keys are turned "on" and "off", the operation of the chord/root note write-in pulse generator 33 is ceased for a fixed time so as to prevent the operation of detecting a chord unfavorable for the performance.

While the chord signal CH1, CH2, CH3 is delivered directly from the chord terminals, it is decoded by a decoder 38 into the chord type signal (major, minor, . . .) or the erroneous key depression signal ER. When a control signal of ACC-m or ACC-7th exixts in an ACC-m, 7th control circuit 39, an output from the decoder 38 is converted into a signal of m (minor) or 7th (seventh) irrespective of the chord type signal transmitted from the decoder 38. On the other hand, when the ACC-m or ACC-7th control signal is not applied, the output of the decoder 38 is supplied to an ACC signal generator 40 as it is, and the note assignment signal ACC for the auto-bass accompaniment is generated.

The pedal assignment signal $I_P$ is waveshaped by a timing signal waveshaping circuit 41 and then supplied to a pedal note detector 42, which generates a note detecting pulse signal PED-P for detecting the note of the pedal and also a pedal depression signal FOOT. The pedal depression signal FOOT is supplied to a pedal-/auto-bass switching signal generator 43 along with a signal ATK-P supplied from an ATK (attack) pulse generator 44, thereby to generate a signal PEDAL for switching the ordinary performance with the pedal and the auto-bass accompaniment. When the ATK-P signal is applied in the absence of the pedal depression signal FOOT transmitted from the pedal note detector 42, the operation is switched to the auto-bass accompaniment. A signal PEDAL-On from the pedal/auto-bass switching signal generator 43 as indicates the depression of the pedal and a signal MANU-ON from the ACC ON-OFF signal generator 34 as indicates the depression of the accompanying key are time-divided by the timing signals $T_{01}$, $T_{02}$ in a multiplexer 50, whereupon they are delivered from the 'key' terminal as the KEY signal.

A note signal generator 51 generates binary-word note signals $N_8$, $N_4$, $N_2$, $N_1$ as in Table 7 corresponding to the twelve notes $C_L$, C#, . . . , B of the accompanying keys and the thirteen notes $C_L$, C#, . . . , $C_H$ of the pedals.

Table 7

| Note | Binary word $N_8$ | $N_4$ | $N_2$ | $N_1$ |
|---|---|---|---|---|
| $C_L$ | 0 | 0 | 0 | 0 |
| C# | 0 | 0 | 0 | 1 |
| D | 0 | 0 | 1 | 0 |

Table 7-continued

| Note | Binary word | | | |
|---|---|---|---|---|
| | $N_8$ | $N_4$ | $N_2$ | $N_1$ |
| D# | 0 | 0 | 1 | 1 |
| E | 0 | 1 | 0 | 0 |
| F | 0 | 1 | 0 | 1 |
| F# | 0 | 1 | 1 | 0 |
| G | 0 | 1 | 1 | 1 |
| G# | 1 | 0 | 0 | 0 |
| A | 1 | 0 | 0 | 1 |
| A# | 1 | 0 | 1 | 0 |
| B | 1 | 0 | 1 | 1 |
| $C_H$ | 1 | 1 | 0 | 0 |

These note signals representative of the respective notes are decoded into the corresponding timing signals $T_{01}$, $T_{02}$, . . . , $T_{013}$ (refer to FIG. 4) by a decoder 52. Such decoder outputs are made the timing signals $T_1$, $T_2$, . . . , $T_{13}$ narrowed by the timing pulse $\tau_3+\tau_4+\tau_5$ (refer to FIG. 5) by means of a gate circuit 53. The narrowed timing pulses are respectively delivered from the terminals $t_1$, $t_2$, . . . , $t_{13}$ so as to subject the external circuits to the time-division control.

Figure 8:
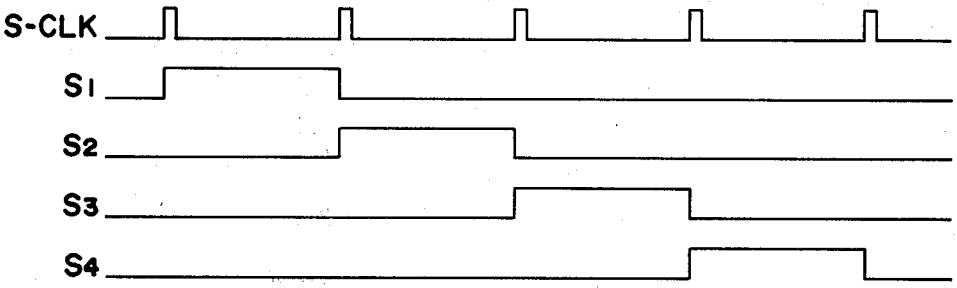
FIG. 8 is an operating timing diagram of a sequence signal generator circuit.

A signal S-CLK generated from the note signal generator 51 is supplied to a sequence control signal generator 54, to generate sequence signals $S_1$, $S_2$, $S_3$, $S_4$ (refer to FIG. 8) for the time-division control of various circuits. Further, various control signals received at the ib terminal are converted from serial signals into parallel signals by a demultiplexer 55 and become various d.c. signals. Among them, a 4-bit binary signal output $I_8$, $I_4$, $I_2$, $I_1$ changes the major third signal into the minor third signal when the BASS-m control signal is applied to a BASS-m, 7th control circuit 56, and it changes the perfect fifth signal into the minor seventh signal when the VASS-7th control signal is applied. The 4-bit binary degree signal is supplied to an adder 57, in which it is added to a 4-bit binary root note signal from an accompanying key root note memory 58 so as to make a scale correction. Here, the root note memory 58 stores the root note in such a way that the 4-bit note signal of the note signal generator 51 is latched at the timing of a signal ACD-P prepared from the key depression signal $I_K$ of the accompanying key.

A pedal/auto-bass switching circuit 59 selects a binary signal from the adder 57 or a pedal note memory 60 by the use of the PEDAL signal, and transmits it to a divide-by-13 correction circuit 61. Also the pedal note memory 60 stores the root note in such a way that the 4-bit note signal of the note signal generator 51 is latched by a signal PED-P prepared from the pedal depression signal $I_P$ of the pedal. In the divide-by-13 correction circuit 61, when the added value in the adder 57 exceeds a digital value corresponding to the bass note $C_H$, it is corrected to a digital value of the corresponding bass note. Besides, the divide-by-13 correction circuit 61 transmits to an octabe switching circuit 62 a signal OCTABE for controlling the octave of the bass tone. A 4-bit binary note signal $B_1$, $B_2$, $B_4$, $B_8$ from the divide-by-13 correction circuit 61 as assigns the bass note is converted by a decoder 63 into a d.c. signal for assigning the bass note. Thereafter, a bass tone signal of the assigned bass note $C_L$, C#, . . . , $C_H$ is generated by a bass tone generator 64, and the bass tone signal BASS is delivered from the 'bass' terminal via the octave switching circuit 62.

In this manner, the automatic accompaniment is effected by the automatic accompanying circuit and the peripheral circuits connected thereto. Hereunder, the principal circuits will be described more in detail.

Figure 9:
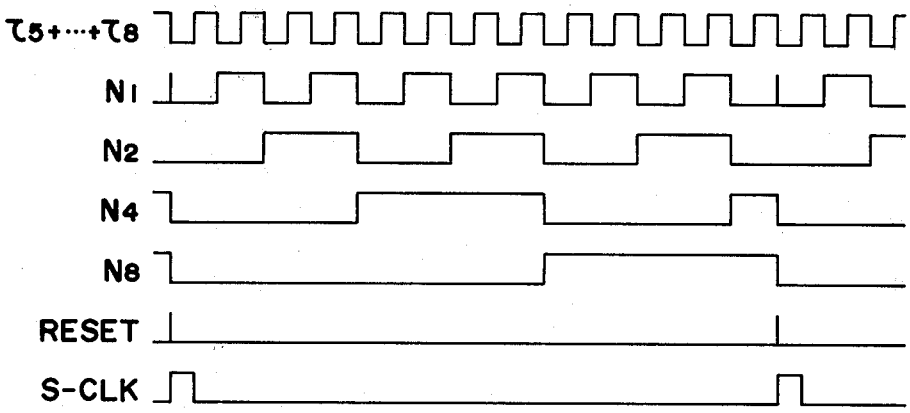
FIG. 9 is a schematic diagram of the note signal generator.

III. Generation of Parallel Timing Signals and Input Circuit Portions of Key Depression Signals:

Using the timing pulse $\tau_5+\ldots+\tau_8$ produced by the timing pulse generator 30 the parallel timing signals are made by the note signal generator 51, the decoder 52 and the gate circuit 53. The note signal generator 51 may be a divide-by-13 counter which consists of four series-connected toggle flip-flops with reset terminals and a reset circuit therefor. The divide-by-13 counter has its output state changed in succession by the timing pulses $\tau_5+\ldots+\tau_8$ produced by the timing pulse generator 30. In this way, the note signal $N_1$, $N_2$, $N_4$, $N_8$ of the binary word indicated in Table 7 and FIG. 9 is provided on the output side of the note signal generator 51. The signal S-CLK is provided from the reset circuit every reset operation.

The note signals representative of the respective notes are decoded into the corresponding timing signals $T_{01}$, $T_{02}$, . . . , and $T_{013}$ (refer to FIG. 4) by the decoder 52. Such decoded signals are narrowed by the timing pulse $\tau_3+\tau_4+\tau_5$ in the gate circuit 53 and become the timing signals $T_1$, $T_2$, . . . , and $T_{13}$ respectively (refer to FIG. 5), which are delivered from the terminals $t_1$, $t_2$ . . . and $t_{13}$ and supplied to the pedal keyboard circuit 3 and the accompanying keyboard circuit 4 as described before.

The pedal keyboard circuit 3 and the accompanying keyboard circuit 4 provide only the timing signals corresponding to the assigned keys. These signals are respectively converted into the key depression signals of serial timings by the OR circuits 5 and 6 and entered into the automatic accompanying LSI circuit again. The input circuit portions of the LSI circuit are the timing signal waveshaping circuits 31 and 41. The details of the timing signal waveshaping circuit 31 are shown in FIG. 10, and the operating timing diagram thereof is illustrated in FIG. 11.

Figure 13:
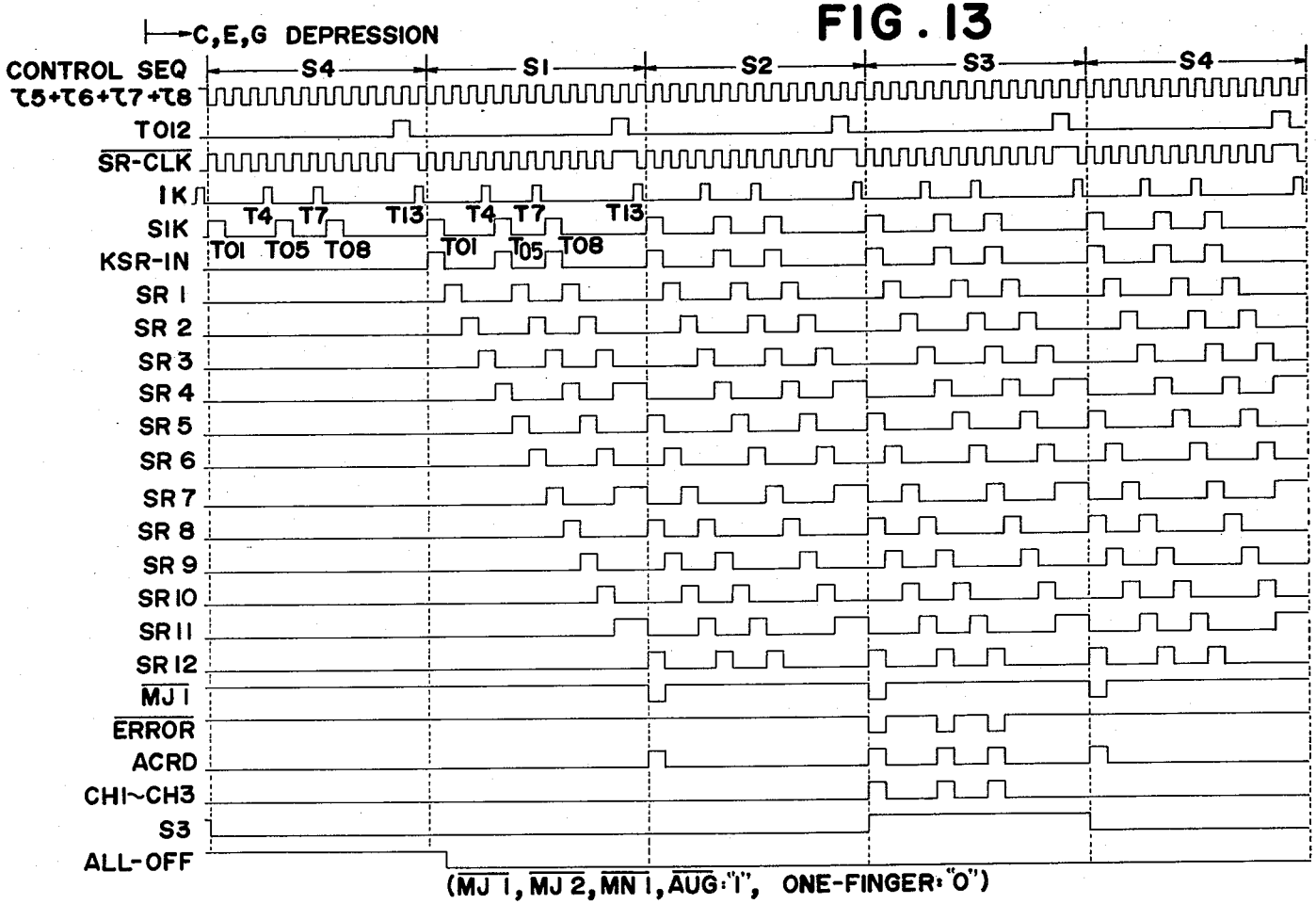
FIG. 13 is an operating timing diagram of the chord detector in the case where keys C, E and G are depressed.

The timing signal waveshaping aircuit 31 is constructed of an AND gate 31*a*, an SR flip-flop 31*b*, a delayed flip-flop 31*c* and an inverter 31*d*. The ik terminal input is impressed on one input terminal of the AND gate 31*a*, while the timing pulse $\tau_5$ is applied to the other input terminal as a strobe signal. A strobed output signal of the AND gate 31*a* is a set signal of the SR flip-flop 31*b*. An output $Q_1$ of the SR flip-flop 31*b* is sent to the delayed flip-flop 31*c*, in which it is delayed one timing (one bit) by employing as a clock signal the inverted signal of the timing pulse $\tau_5+\ldots,\tau_8$ owing to the inverted 31*d* and becomes a waveshaped signal SIK. The timing pulse $\tau_3$ is impressed on a reset terminal of the SR flip-flop 31*b*, to reset a stored content of this flip-flop 31*b*. Assuming by way of example that key D has been depressed, the key depression signal enters the ik input terminal at the timing $T_{02}$ as illustrated in FIG. 13. The key depression signal is supplied to the AND gate 31*a*, strobed by the timing signal $\tau_5$ and supplied to the SR flip-flop 31*b*. If the width of the pulse obtained by the strobing is equal to or greater than a set-up time of the SR flip-flop 31*b*, the presence of an input is judged, and the SR flip-flop 31*b* is set. The set state is held until the next reset pulse (timing pulse $\tau_3$) arrives. The $Q_1$ output is supplied to the delayed flip-flop 31*c* and is stored at the inverted timing pulse $\overline{\tau_5+\ldots+\tau_8}$, so that the SIK signal is delivered at the timing $T_{03}$ one timing (one bit) later.

In electronic musical instruments in which, as in the automatic accompanying apparatus, the time-divided serial note assignment signals are prepared with the timing output signals of their own, it is necessary to solve the problem of time lags and to improve the response characteristic at the key depression, thereby to prevent maflunctions due to noise etc. The time lags consist mainly of lags attributed to wiring capacitances of the pedal keyboard and the manual keyboard, and time lags in the OR gates for taking the sums of the signals corresponding to the respective keys. As a measure against such time lags, it is thought that the pulse width may be extended. The extension of the pulse width, however, results in lowering the frequency of the timing output signals and lengthening the response time at the key depression. It is therefore impracticable.

Figure 10:
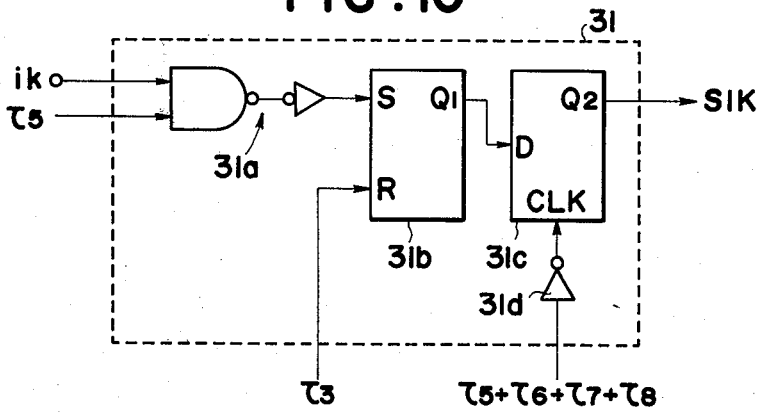
FIG. 10 is a schematic diagram which shows a timing signal waveshaping circuit.
Figure 11:
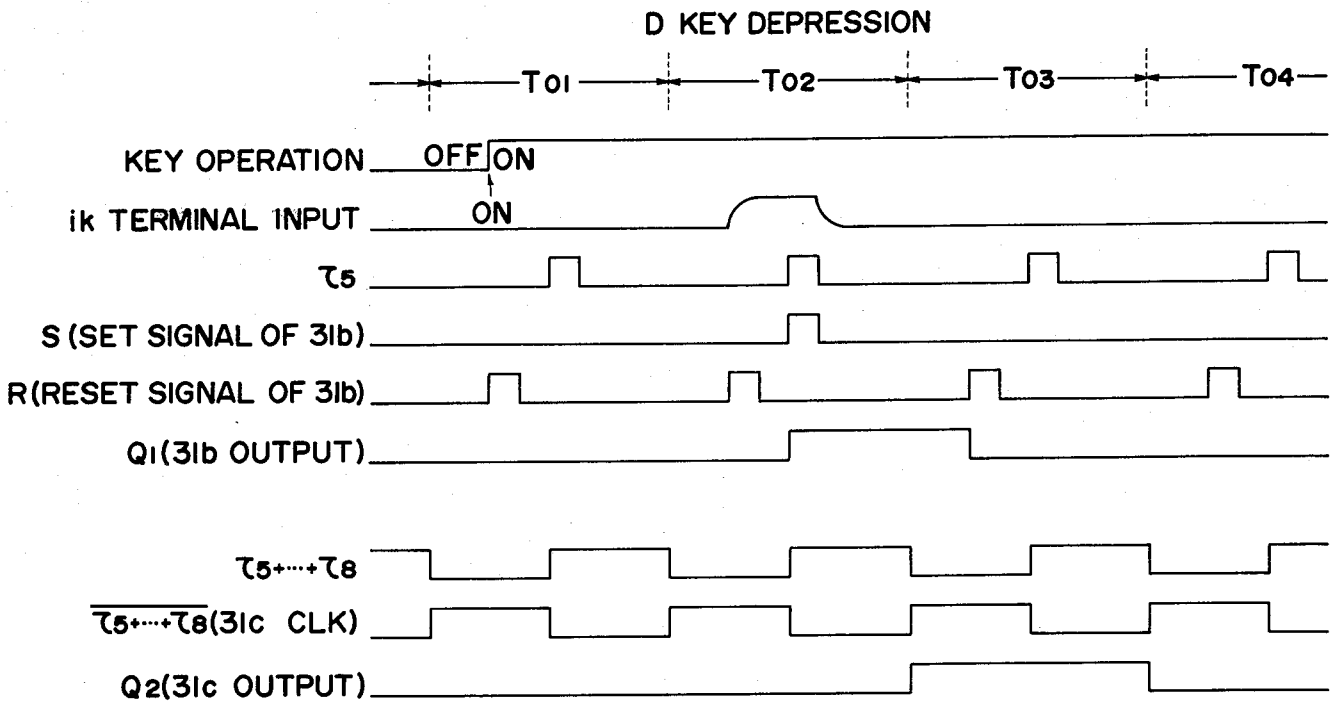
FIG. 11 is an operating timing diagram of the timing signal waveshaping circuit at the time when key D is depressed.

In contrast, when the circuit arrangement as shown in FIG. 10 is adopted, the final period of the pulse having entered the ik terminal is strobed, so that the operation is possible even in the presence of the delay approximately equal to the pulse width. The delay approximately equal to the pulse width. The illustrated circuit arrangement is also effective for signals including chattering as in case where the signals are turned "on" and "off" directly by keys. Furthermore, under a bad condition under which a noise is induced, even when the noise is induced in a period other than the strobing period, no malfunction occurs because the input signal is strobed. Since the strobing is carried out in $\frac{1}{8}$ of the whole period, the circuit of the embodiment is 8 times higher in the pulse immunity than a circuit in which the measure is not taken. When, in an actual circuit, a pulsatile noise is induced to cause a malfunction, a capacitor may be incorporated in the input line of the ik terminal so as to absorb the pulse energy.

The SIK signal thus prepared is sent to the chord detector 32 to detect the 3-bit binary chord signal CH1, CH2, CH3 as described previously.

The timing signal waveshaping circuit 41 into which the pedal assignment signal $I_P$ transmitted from the pedal keyboard 3 is entered is constructed and operated similarly to the timing signal waveshaping circuit 31 set forth above. The waveshaped signal is sent to the pedal note detector 42.

IV. Chord Detection:

In the automatic accompanying apparatus wherein a performer assigns a chord name (such as C major and D minor) on the accompanying keyboard and wherein the automatic accompaniment of a bass tone and a chord tone complying therewith is effected, there is required the chord detector which detects the chord name defined by depressed accompanying keys.

In this regard, the number of key depression states which are assigned by the performer is very large, and the degree of comlicacy of the circuit arrangement becomes greatly different depending on what chord detection system is adopted. Therefore a variety of chord detection systems have hitherto been proposed, but they are not always fully satisfactory from the viewpoints of simplification of the circuit arrangement, adaptability to the form of an LSI, etc.

Figure 12:
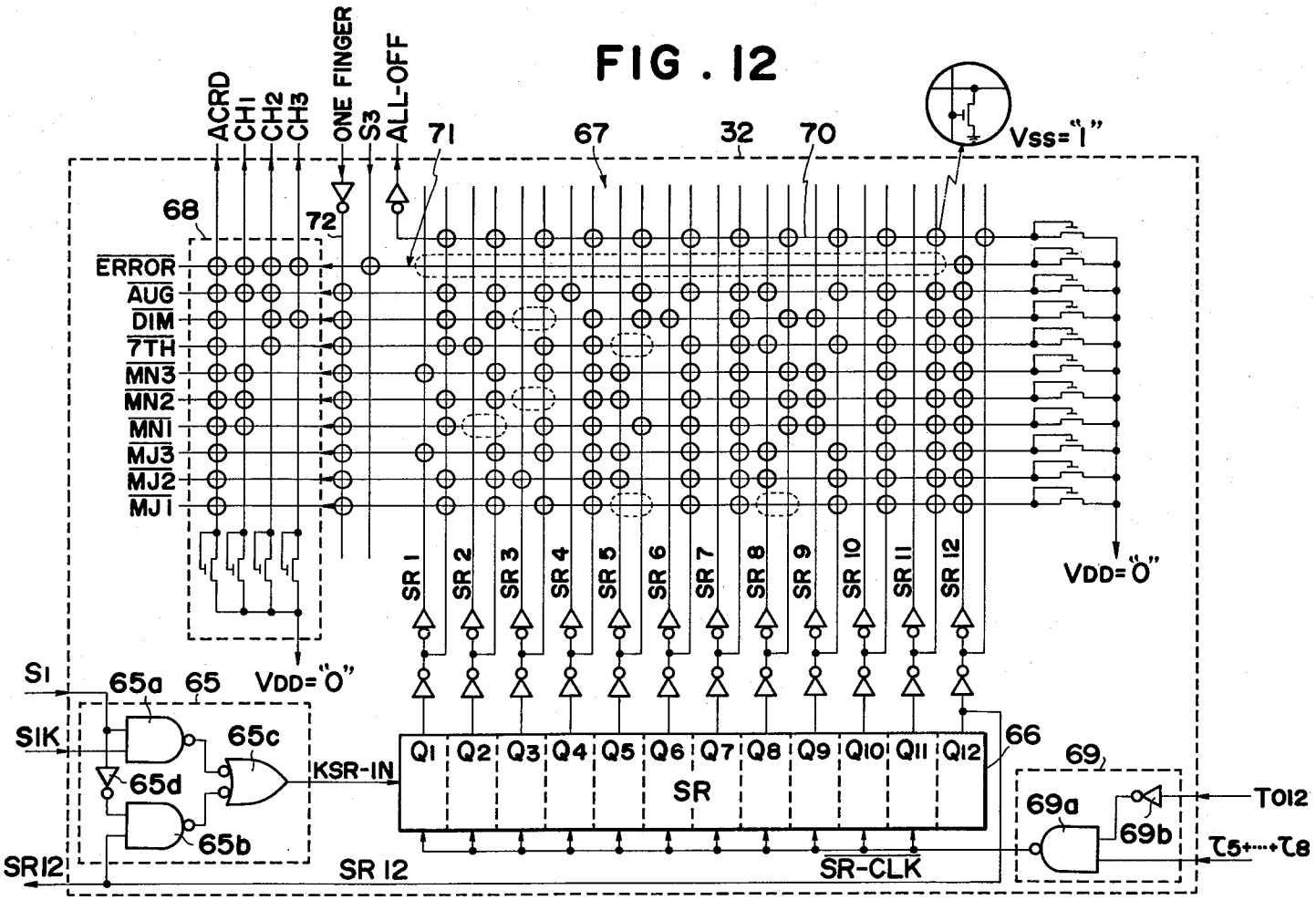
FIG. 12 is a schematic diagram of a chord detector.

Referring to FIG. 12, the chord detector 32 is constructed of a shift/write switching circuit 65 which receives the output from the timing signal waveshaping circuit 31, a shift register of the serial input/parallel output type, a first ROM (chord ROM) 67 which stores therein the basic forms of chord names (for example, various C chords) to be controlled by the shift register 66, a second ROM 68 for generating the chord coincidence signal ACRD and the binary signal CH1, CH2, CH3 representative of the type of the chord, and a clock correction circuit 69 for the shift register.

The operation of the chord detector 32 will be described with reference to the operating timing diagram of FIG. 13. The shift/write switching circuit 65 has two positive-logic NAND gates 65*a* and 65*b* and a gate 65*c*. The first NAND gate 65*a* receives the sequence signal $S_1$ from the sequence signal generator 54, and the signal SIK waveshaped by the timing pulse waveshaping circuit 31. The second NAND gate 65*b* receives the inverted signal $\overline{S_1}$ of the sequence signal $S_1$ as produced by an inverter 65*d*, and the serial outputs of the shift register 66. The output KSR-IN of the gate 65*c* is sent to the shift register 66. When the sequence signal $S_1$ is at the H (high) level, the SIK signal is fed to the shift register 66 through the NAND gate 65*a* as well as the gate 65*c*, whereas when the sequence signal $S_1$ is at the L (low) level, the serial outputs of the shift register 66 are again fed into the shift register through the NAND gate 65*b* as well as the gate 65*c*. That is, the shift/write switching circuit 65 is a circuit for selecting whether the key depression signal of the accompanying keyboard is written into the shift register 66 is the period of the time-division control sequence $s_1$ or the key depression signal is stored while being cyclically shifted in any period other than $s_1$.

Here is supposed a case where keys C, E and G have been depressed on the accompanying keyboard to assign the C major chord. Then, the serial timing signal $I_K$ of the timings $T_{13}$, $T_4$ and $T_7$ is applied to the 'ki' terminal, and the signal SIK waveshaped by the timing pulse waveshaping circuit 31 is impressed on the chord detector 32. As stated previously, the SIK signal is applied as the input signal KSR-IN of the shift register 66 only during the period of the control sequence $s_1$ under the action of the shift/write switching circuit 65. The shift register 66 is constructed of 12 bits, its contents are successively shifted by the output pulses $\overline{\text{SR-CLR}}$ of the clock correction circuit 69, and it provides output signals SR1, . . . , and SR12 in parallel. The clock correction circuit 69 is made up of a NAND gate 69*a* and an inverter 69*b*. The inverted signal by the inverter 69*b*, of one $T_{012}$ of the timing signals from the decoder 52 for generating the note allotment timing pulses, and the timing pulse $\tau_5 + \ldots + \tau_8$ from the timing signal generator 30 are supplied to the NAND 69*a*, while the shift pulse $\overline{\text{SR-CLK}}$ is delivered therefrom.

The output signals SR1, . . . , and SR12 of the shift register 66 are entered into the chord ROM 67, and are directly compared with the stored contents thereof. ROM lines at which the comparison results are coincident are activated, and the binary information representative of the type of the corresponding chord is read out from the second ROM 68.

In case where the keys C, E and G have been depressed as stated above, a lateral ROM line $\overline{\text{MJ1}}$ is activated in the periods of the time-division control sequences $s_2$, $s_3$ and $s_4$ and at the timing $T_{01}$ and a ROM line $\overline{\text{ERROR}}$ is activated in the period of $s_3$ and at the timings $T_{01}$, $T_{05}$ and $T_{08}$ so as to provide the chord coincidence signal ACRD and the chord type indicating signal CH1, CH2, CH3 (refer to Table 3-1). That is, in case of the above key depression pattern, the second ROM 68 is read out by the ROM line $\overline{\text{MJ1}}$, and the signal CH1, CH2, CH3 become "0", "0", "0".

To be noted here is that there are places (ellipses of broken lines in FIG. 12) in which no activating transistor is disposed between the chord ROM lines of the first ROM 67 and the parallel output lines of the shift register 66. As regards, e.g., the line $\overline{MJ1}$, no transistor is disposed in the places of the $Q_5$ output line and $Q_8$ output line of the shift register 66. Accordingly, irrespective of whether the outputs SR5 and SR8 are "1" or "0", the line $\overline{MJ1}$ is activated if the other shift register outputs are coincident with the stored contents of the ROM. In other words, the line $\overline{MJ1}$ corresponds to four key depression states of (C), (C, E), (C, G) and (C, E, G).

Assuming by way of example that the key C has been depressed on the accompanying keyboard to assign the C major chord, the serial timing signal of the timing $T_{13}$ is applied to the terminal 'ik', and the line $\overline{MJ1}$ is activated in the sequence $s_2$ and at the timing $T_{01}$. In all the cases where the keys C and E have been depressed, where the keys C and G have been depressed and where the keys C, E and G have been depressed, the line $\overline{MJ1}$ is activated in the sequence $s_2$ and at the timing $T_{01}$ and the signal CH1, CH2, CH3 becomes "0", "0", "0". Since, in this manner, a plurality of sorts of key depression patterns are caused to correspond to one ROM line, the first ROM 67 can be shortened. That is, many types of chords can be stored and detected by the use of ROM of small memory capacity, the circuit arrangement can be made simpler, and the measure is very effective for putting the circuit device into the form of an IC or LSI.

Figure 14:
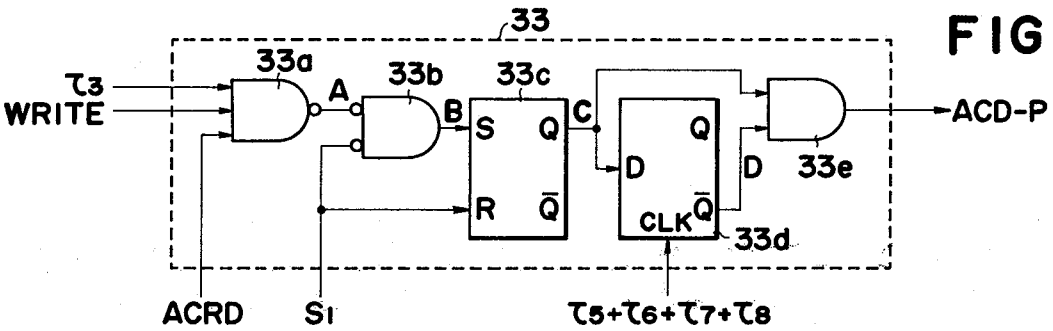
FIG. 14 is a schematic diagram of a chord/root note write-in pulse generator.
Figure 15:
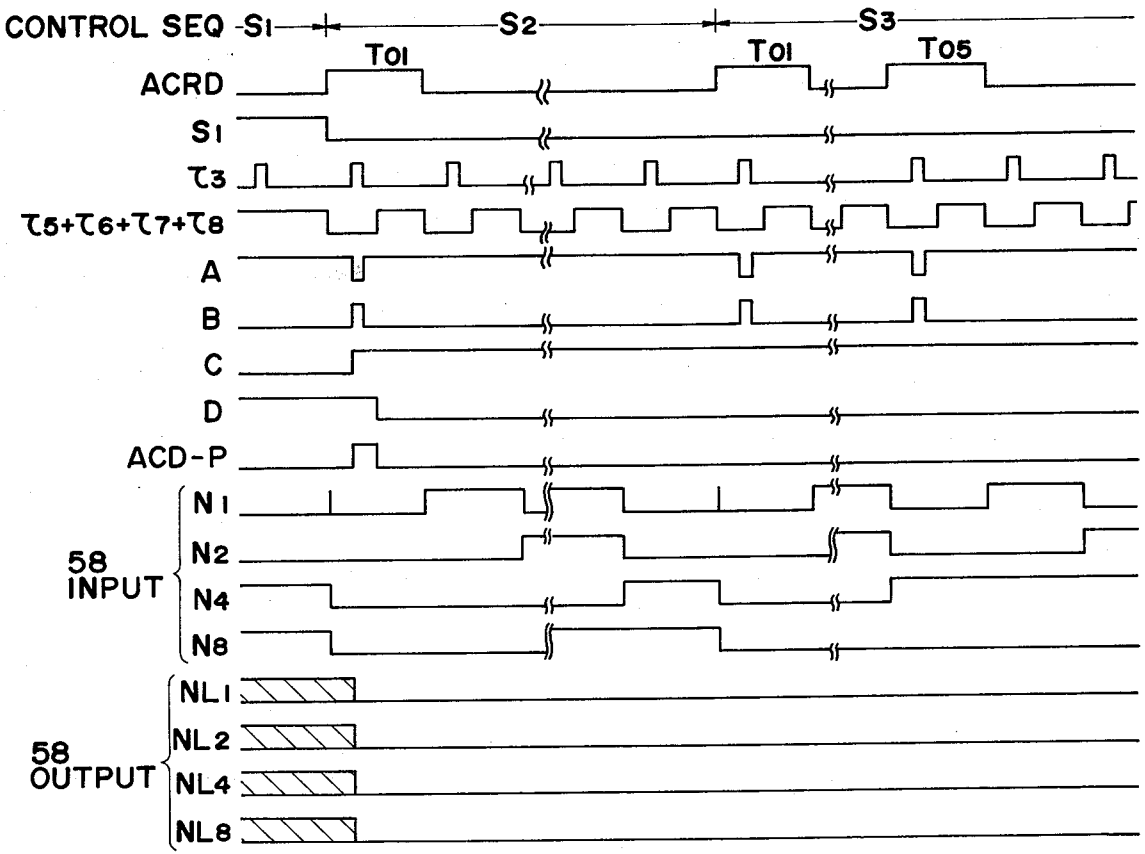
FIG. 15 is an operating timing diagram of the chord-/root note write-in pulse generator as well as an accompanying ket note memory.

The chord coincidence signal ACRD generated from the chord detector 32 is entered into the chord/root note write-in pulse generator 33, to generate a chord-/root note write-in pulse ACD-P. A concrete example of the chord/root note write-in pulse generator 33 is as shown in FIG. 14. It is made up of three logic gates 33*a*, 33*b* and 33*e*, an SR flip-flop 33*c* and a delayed flip-flop 33*d*. As understood from the operating timing diagram of FIG. 15, a preference is given to the chord coincidence signal ACRD which arrives first in a period subsequent to to the time-division control sequence $s_1$, and the chord/root note write-in pulse ACD-P is generated at the timing thereof. In any of the cases of depressing the key C, the keys C and E, the keys C and G and the keys C, E and G, the ACD-P pulse is generated at the timing $T_{01}$ in the time-division control sequence $s_1$. The ACD-P pulse is sent to the accompanying key note memory 58 constructed of a 4-bit latch circuit, to latch the note information at that time. It is also sent to the chord memory 37 together with the chord type indicating signal CH1, CH2, CH3 generated from the chord detector 32.

In this manner, the key depression signals indicative of the key notes which the performer has actuated by the keyboard operations are stored in the shift register, and while cyclically shifting the stored contents of the shift register, they are directly compared with the ROM storing therein the basis forms of chord names (for example, various C chords), whereby the binary word representative of the corresponding chord type is directly read out from the second ROM connected to the coincident ROM line, and besides, the root note of the chord is detected from the number of shifts till the readout of the chord type.

In the present embodiment, the shift register of the serial input/parallel output type is employed. The reason therefor is that, in this automatic accompanying apparatus, the key depression signals are entered into the chord detector as the serial timing signals. In an automatic accompanying apparatus of a circuit arrangement wherein key depression signals are entered into a chord detector in parallel, a shift register of the parallel input/parallel output type may be used.

V. Indication of Key Depression or Key Release State:

The first ROM 67 is provided with a ROM line 70 for detecting "ALL-OFF" as described previously, whereby the key depression or key release state of the accompanying keyboard can be indicated over the whole period.

The ALL-OFF detecting ROM line 70 has the activating transistors incorporated for the respective inverted parallel output lines of the shift register 66, and an output is derived through an inverter. Accordingly, when all the shift register outputs SR1–SR12 are "0," the ALL-OFF signal becomes "1." At any other time, that is, when at least one of the shift register outputs SR1–SR12 is "1," the ALL-OFF signal is "0."

Assuming that any desired key has been depressed on the accompanying keybord, the SIK signal corresponding thereto is written into the shift register 66 in the period of the time-division control sequence $s_1$ and the stored content of the loaded shift register 66 is cyclically shifted. Accordingly at least one of the outputs SR1–SR12 of the shift register 66 becomes "1," so that the ALL-OFF signal becomes "0."

Conversely, assuming that any accompanying key has been released, no signal is written in the subsequent time-division control sequence $s_1$, and hence, the stored contents in the shift register 66 are sequentially shifted. At the time when all the outputs SR1–SR12 of the shift register 66 have become "0," the ALL-OFF signal becomes "1." Thus, some time difference exists between the time when the key has been actually depressed and the time when the ALL-OFF signal indicative of the key depression state becomes "0" or between the time when the key has been actually released and the time when the ALL-OFF signal indicative of the key release state becomes "1." It is always possible, however, to detect whether the accompanying keyboard is in the key depression state or the key release state.

Figure 16:
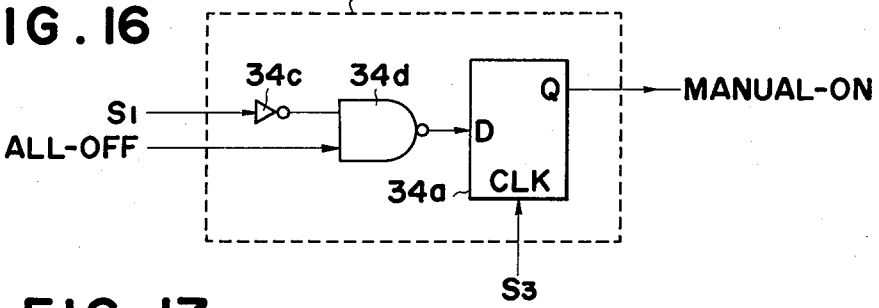
FIG. 16 is a schematic diagram of an accompanying key ALL-OFF signal generator.
Figure 17:
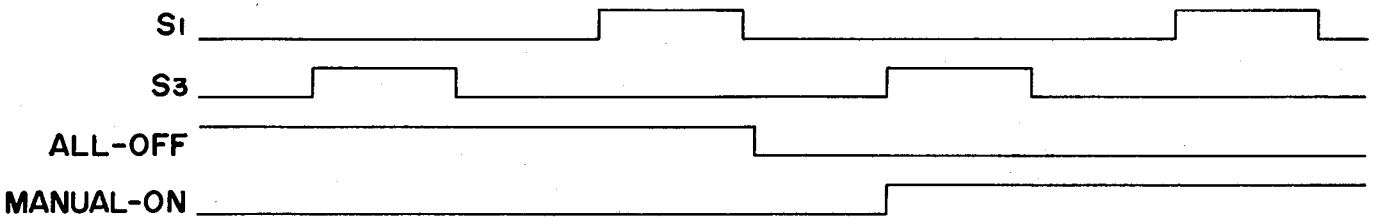
FIG. 17 is an operating timing diagram of the accompanying key ALL-OFF signal generator.

The ALL-OFF signal obtained in this way is transmitted to the accompanying key ALL-OFF signal generator 34. A concrete example of the accompanying key ALL-OFF signal generator 34 is as shown in FIG. 16. It is composed of a delayed flip-flop 34*a*, a NAND gate 34*d* and an inverter 34*c*. The sequence signal $S_1$ is sent to one input of the NAND gate 34*d* through the inverter 34*c*, while the ALL-OFF signal is directly sent to the other input of the NAND gate 34*d*. An output from the NAND gate 34*d* is sent to the D terminal of the flip-flop 34*a*, and the sequence signal $S_3$ to the CLK terminal thereof. An output from the flip-flop 34*a* is sent to the multiplexer 50 as the MANUAL-ON signal. The operating timings of such signals are illustrated in FIG. 17. That is, the MANUAL-ON signal is a signal indicating that the accompanying key is in the depressed condition.

VI. Function of Erroneous Chord Detection:

As described before, the chord detector can be constructed of the ROM which stores the types of chords therein, and the shift register which stores the state of key depression therein and which shifts the stored contents cyclically. The ROM which stores therein the types of chords to be detected has the memory capacity limited from the circuit arrangement, the cost etc. Even in case of detecting the types of chords with any other circuit arrangement, it is inevitable that the circuit becomes more complicated as the number of the chord types to be detected becomes larger.

Accordingly, a chord detector is adopted which detects only the types of principal chords of high frequency of use as are musically important, for example, only major, minor, seventh etc. From the standpoint of the performer, however, even when any chord other than the principal chords has been assigned, an automatic bass accompaniment consistent with the chord needs to be done.

In the present chord detector, therefore, even in case where any irregular chord other than the principal chords has been assigned by depressing keys, one desired tone (e.g., the lowest tone) among the depressed keys is preferentially detected, and the detected tone is generated as a bass tone so as to effect the bass accompaniment, whereby a musically favorable performance can be executed.

More specifically, the first ROM 67 and the second ROM 68 are provided with a ROM line 71 for erroneous chord detection, which is controlled by the sequence signal $S_3$. If the key depression chord is a chord which is not stored in the chord ROM 67, this chord ROM is not activated in the period of the time-division control sequence $s_2$, the ROM line 71 for detecting the erroneous operation is activated in the period of the time-division control sequence $s_3$ and at the timing of the key depression tone, and the chord coincidence signal ACRD and a binary information representative of the erroneous chord are provided from the second ROM 68. In the time-division control sequence $s_3$, even in case where any chord stored in the chord ROM 67 has been had its key depressed, the ROM line $\overline{\text{ERROR}}$ is activated. This, however, poses no problem because the next stage is constructed so that the signal CH1, CH2, CH3 indicative of the chord type may be latched by the timing of the chord coincidence signal ACRD issued first.

Figure 18:
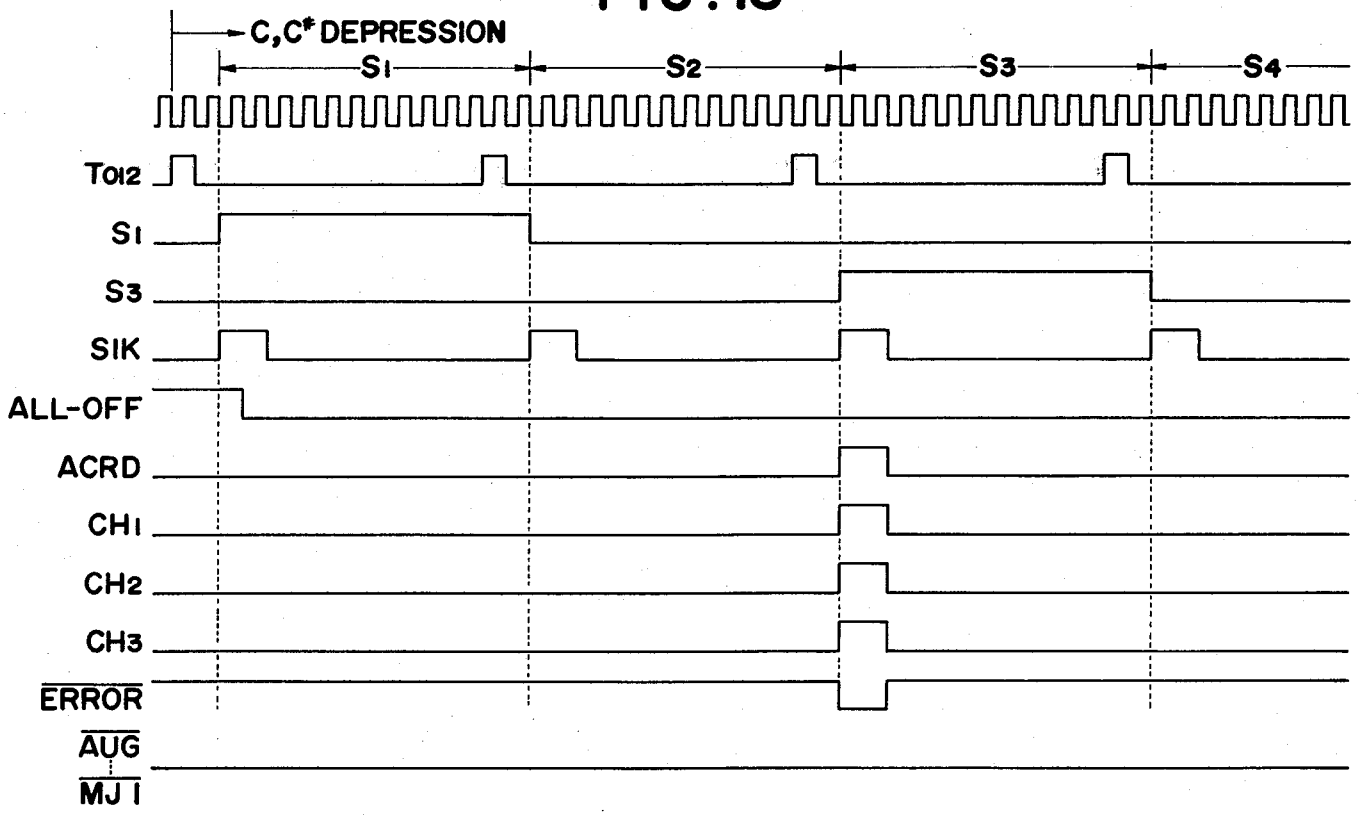
FIG. 18 is an operating timing diagram of the chord detector in the case where keys C and C# are depressed.

Assuming by way of example that keys C and C# have been depressed on the accompanying keyboard, the serial timing signal $I_K$ of the timings $T_{13}$ and $T_1$ is applied to the 'ik' terminal, and the waveshaped SIK signal of the timing $T_{01}$ and $T_{02}$ is sent to the chord detector 32 as illustrated in FIG. 18. The SIK signal is written into the shift register 66 in the period of the time-division sequence $s_1$. During the periods of the sequences $s_2$–$s_4$, the stored contents of the shift register 66 are cyclically shifted and are directly compared with the stored contents of the first ROM 67. Since, however, the chord corresponding to the keys C and C# is not stored, no output is produced in the periods of the sequences $s_2$ and $s_4$ as apparent from FIG. 18. Since the sequence signal $S_3$ is supplied in the sequence $s_3$, the ROM line 71 detecting the erroneous operation is activated at the timings $T_{01}$ and $T_{02}$, and the chord coincidence signal ACRD and a chord type indicating signal representative of the error (CH1, CH2, CH3: "1", "1", "1") are provided (refer to Table 3-1). In this manner, in case where any chord pattern that is not stored in the first ROM 67 has been assigned by the key depression, the chord coincidence signal and the erroneous chord indicating signal can be issued in the period of the sequence $s_3$ and at the timings corresponding to the key depression tone.

Thus, even if the key depression pattern which the performer has assigned by the keyboard operation is the irregular chord other than the chords in the ROM storing the basic forms of chord names (e.g., various C chords) therein, one tone (e.g., the lowest note) contained in the assigned chord can be preferentially detected, so that the circuit arrangement can be extraordinarily simplified. Furthermore, even when the number of the detectable chord types is small, any desired tone in the erroneous chord is given forth as the bass tone so as to effect the bass accompaniment, thereby a musically favorable accompaniment can be smoothly played.

VII. One-Finger Automatic Accompanying Mode:

In an automatic accompanying apparatus wherein a chord name is assigned on an accompanying keyboard so as to effect an automatic chord/bass accompaniment complying with the chord, the chord name is assigned by depressing a plurality of keys. For a beginner, however, the key depressing operation of assigning the chord name by the plurality of keys is difficult, and hence, an effective use of the automatic accompanying apparatus is not easy. For this reason, an automatic accompanying apparatus having the function of the so-called one-finger playing according to which a chord name can be assigned by depressing a single key by one finger has been developed for beginners.

In this regard, if during the use of the automatic accompanying apparatus in the one-finger playing mode a plurality of keys are erroneously depressed and they agree with any stored chord pattern for chord assignment, the root note of the detected chord will be stored in the note memory circuit. Since this state deviates from the type and root note of the chord to be assigned by the one-finger performance, a smooth automatic accompaniment is not attained. The smooth automatic accompaniment is therefore realized in such a way that when the one-finger chord playing mode has been set by externally impressing a one-finger control signal on the chord detector, the operation of detecting a chord by assigning a plurality of keys is ceased and that in case of the depression of a plurality of keys, the lowest note is detected.

As stated previously, the first ROM 67 and the second ROM 68 are provided with the ROM line 71 for detecting the erroneous chord. The erroneous chord detecting ROM line 71 has the activating transistor incorporated for only the Q12 output line of the shift register 66 in the first ROM 67, and is controlled by the sequence signal $S_3$. A one-finger control signal line 72 is provided along the parallel output lines of the shift register 66. The one-finger control signal line 72 has the activating transistors disposed for all the chord ROM lines other than the erroneous chord detecting ROM line 71, and is supplied with the one-finger control signal ONE FINGER through an inverter (refer to FIG. 12).

Figure 19:
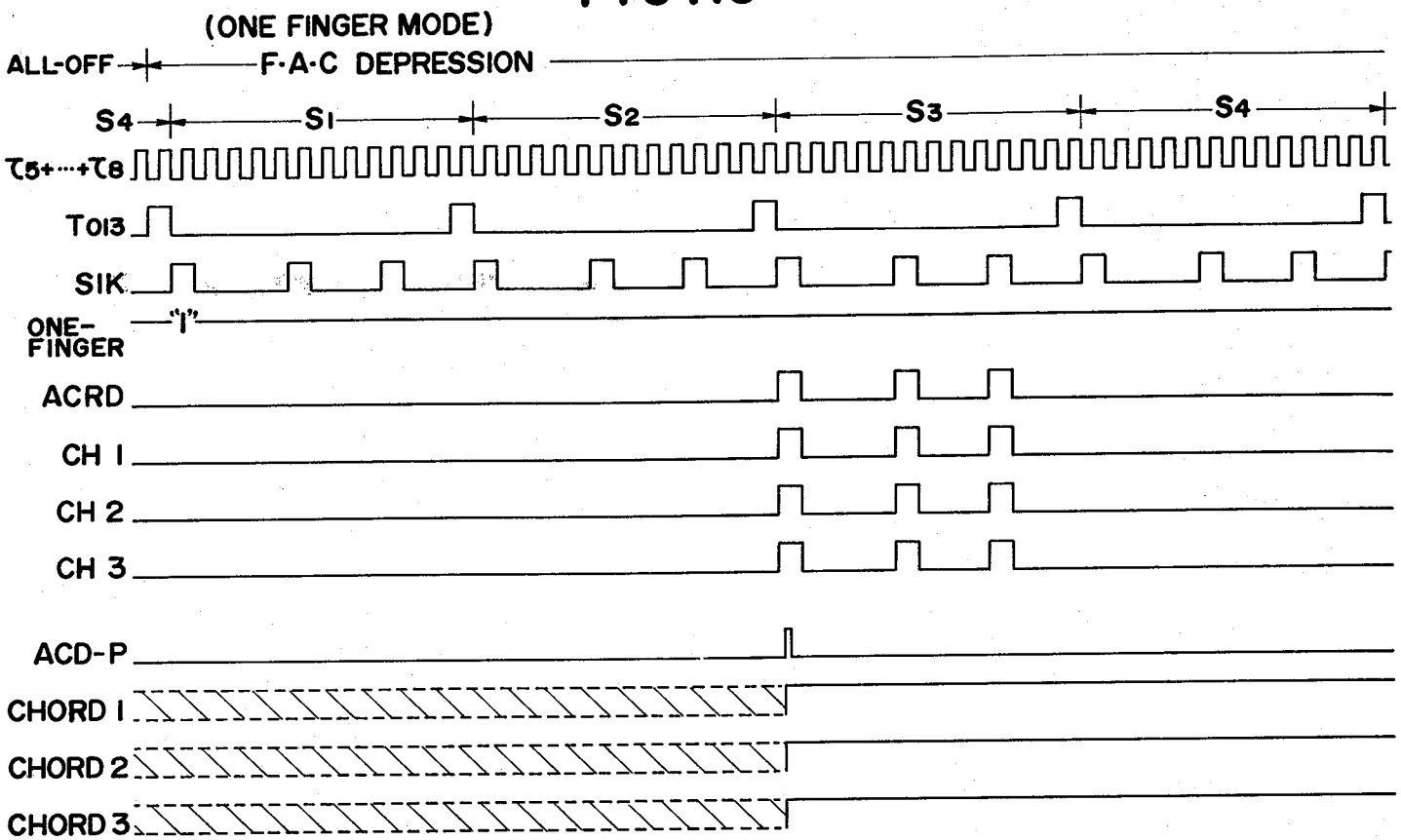
FIG. 19 is an operating timing diagram of the chord detector in the case where keys F, A and C are depressed at the one-finger chord playing mode.

Now, suppose that the one-finger control signal has been received. Then, as understood from FIG. 12, any of the chord ROM lines other than the erroneous chord detecting ROM line 71 is not activated during the period of any time-division control sequence. That is, even when a plurality of keys depressed coincide with any chord pattern stored in the first ROM 67, the second ROM 68 cannot be read out, and the chord detector 32 carries out the same operation as at the key depression of the erroneous chord. By way of example, suppose that keys of the F major chord (F, A, C) have been depressed on the accompanying keyboard in spite of the preceding assignment of the one-finger chord playing mode (refer to FIG. 19). The serial timing signal of the timings $T_{13}$, $T_5$ and $T_9$ is applied to the 'ik' terminal, and the waveshaped SIK signal of the timings $T_{01}$, $T_{06}$ and $T_{010}$ is sent to the chord detector 32 and written into the shift register 66 in the period of the time-division sequence $s_1$. During the periods of the sequences $s_2$–$s_4$, the stored contents of the shift register 66 are cyclically shifted and directly compared with the stored contents of the first ROM 67. However, even when both the stored contents coincide, no output is provided in the periods of the sequences $s_2$ and $s_4$. Since the sequence signal $S_3$ is supplied in the sequence $s_3$, the ROM line 71 for detecting the erroneous key depression is activated at the timings $T_{01}$, $T_{06}$ and $T_{010}$, and the chord coincidence signal ACRD and the chord type indicating signal (CH1, CH2, CH3: "1", "1", "1") are provided from the second ROM 68 (refer to Table 3-1).

By the way, assuming that the keys of the F major chord have been depressed when the performance is not in the one-finger chord playing mode, the ROM line $\overline{MJ1}$ is activated at the timing $T_{06}$, and the chord coincidence signal ACRD and a chord type indicating signal (CH1, CH2, CH3: "0", "0", "0") are provided.

The chord coincidence signal is entered into the chord/root note write-in pulse generator 33, to provide the chord/root note write-in pulse ACD-P at the timing of the chord coincidence signal arriving first. As to the above example, therefore, when the performance is in the one-finger playing mode, the ACD-P pulse is produced at the timing $T_{01}$ of the sequence $s_3$ and the lowest tone among the plurality of depressed keys is detected, whereas when the performance is not in the one-finger playing mode, the ACD-P pulse is generated at the timing $T_{06}$ of the sequence $s_2$ and the root note is detected.

Figure 20:
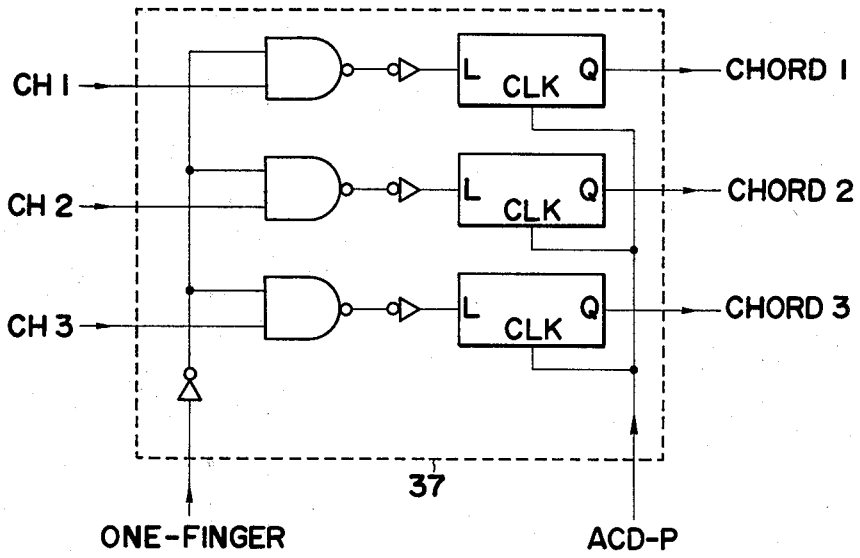
FIG. 20 is a schematic diagram of a chord memory.

The ACD-P pulse is impressed on the chord memory circuit 37 together with the chord type indicating signal CH1, CH2, CH3 generated from the chord detector circuit 32. A concrete example of the chord memory 37 is shown in FIG. 20. It is composed of one inverter, three AND gates and three latch circuits. When the performance is not in the one-finger chord playing mode, the respective bits of the chord type indicating signal CH1, CH2, CH3 from the chord detector 32 are fed to the latch circuits as they are, and they are latched by the ACD-P pulse. When the performance is in the one-finger chord playing mode, the chord type indicating signal is of the erroneous chord indication (CH1, CH2, CH3: "1", "1", "1"), but due to the impression of the one-finger control signal as inverted, the chord type indicating signal is latched by the ACD-P pulse as "0", "0", "0" or as the major chord. In this way, the binary signals representative of the chord are stored and deliveres as an output.

Figure 21:
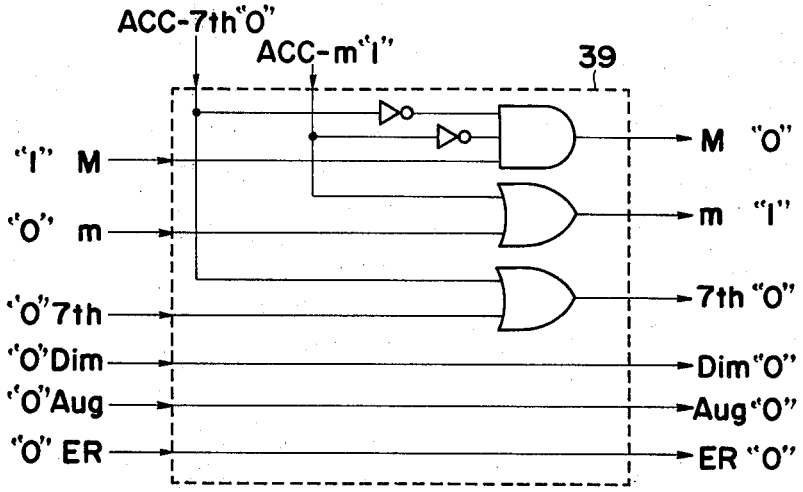
FIG. 21 is a schematic diagram of an ACC-m and 7th control circuit.

The chord signals CH-1, CH-2 and CH-3 are directly delivered from chord terminals, while they are decoded into the chord type signal (major (M), minor (m), . . . ) or the erroneous key depression signal ER by the decoder 38 (refer to Table 3-1). The output of the decoder 38 is sent to the ACC-m and 7th control circuit 39. An example of the ACC-m and 7th control circuit 39 is as shown in FIG. 21, and it can be constructed of a plurality of logic gates. Except when the performance is in the one-finger chord playing mode, the ACC-m or ACC-7th control signal is always "0", so that the output of the decoder 38 is supplied to the ACC signal generator 40 as it is. As illustrated in FIG. 21, when the ACC-m control signal "1" exists at the one-finger mode performance, the output of the decoder 38 is converted so that the minor (m) may become "1" though the major (M) is held at "1," whereupon the converted output is supplied to the ACC signal generator 40. When the ACC-7th control signal is "1," the output of the decoder 38 is converted so that the seventh (7th) may become "1."

In this way, the lowest note among the keys depressed at the time of the one-finger playing mode is detected without appreciably complicating the circuit arrangement, and the performance is continued on the basis of the detected note, so that a smooth automatic accompaniment can be effected.

VIII. Prevention of Chord Detection Unfavorable in Performance:

In case where the player actuates a plurality of keys on the accompanying keyboard and assigns chord names, it is sometimes the acutal condition that a non-uniformity in the keys occurs at a key release or key depression and that the chord name to be properly assigned is not instituted in a keying period. If a chord corresponding to such a non-uniformity in the keys (erroneous chord in performance) is detected as it is, the automatic accompaniment conforming with the desired chord name will become impossible, which is unfavorable musically.

Figure 22:
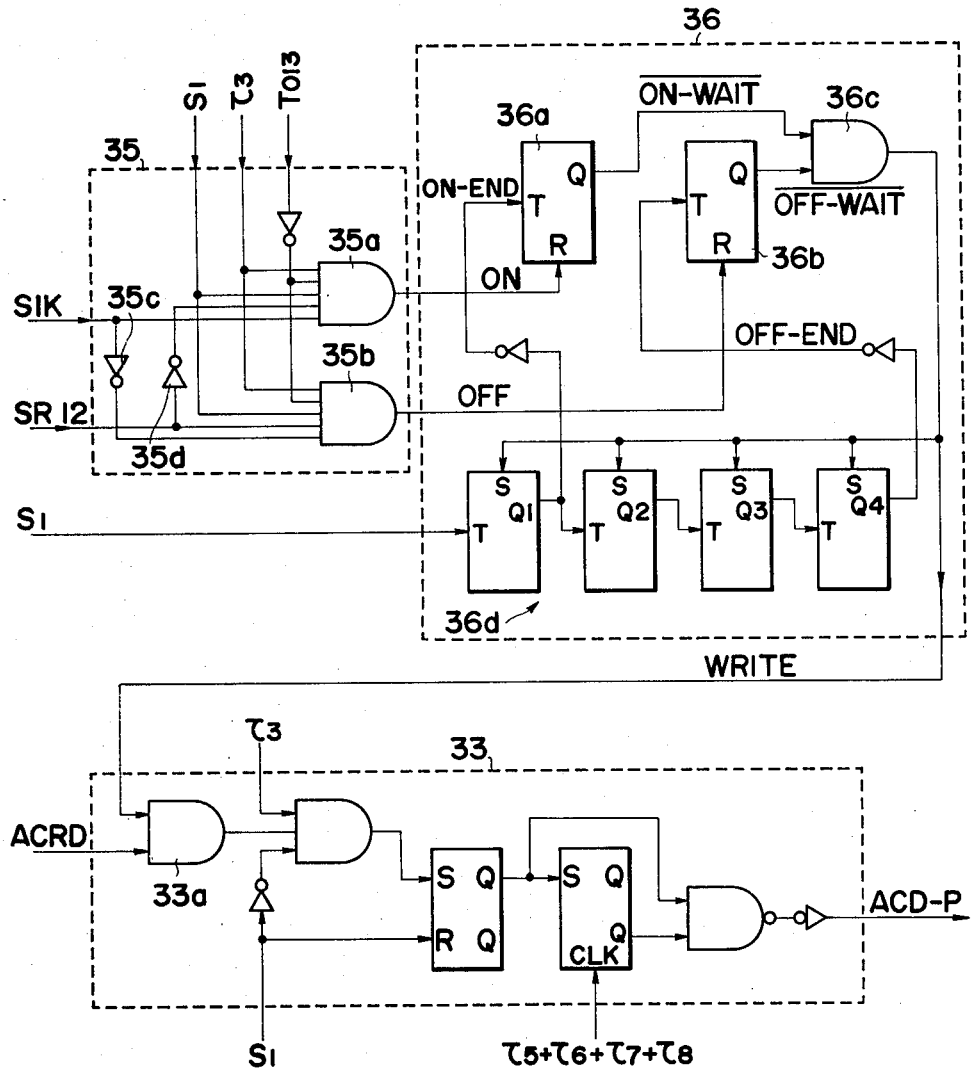
FIG. 22 is a schematic diagram of a keying detector, an inhibit time generator and the chord/root note write-in pulse generator.
Figure 23:
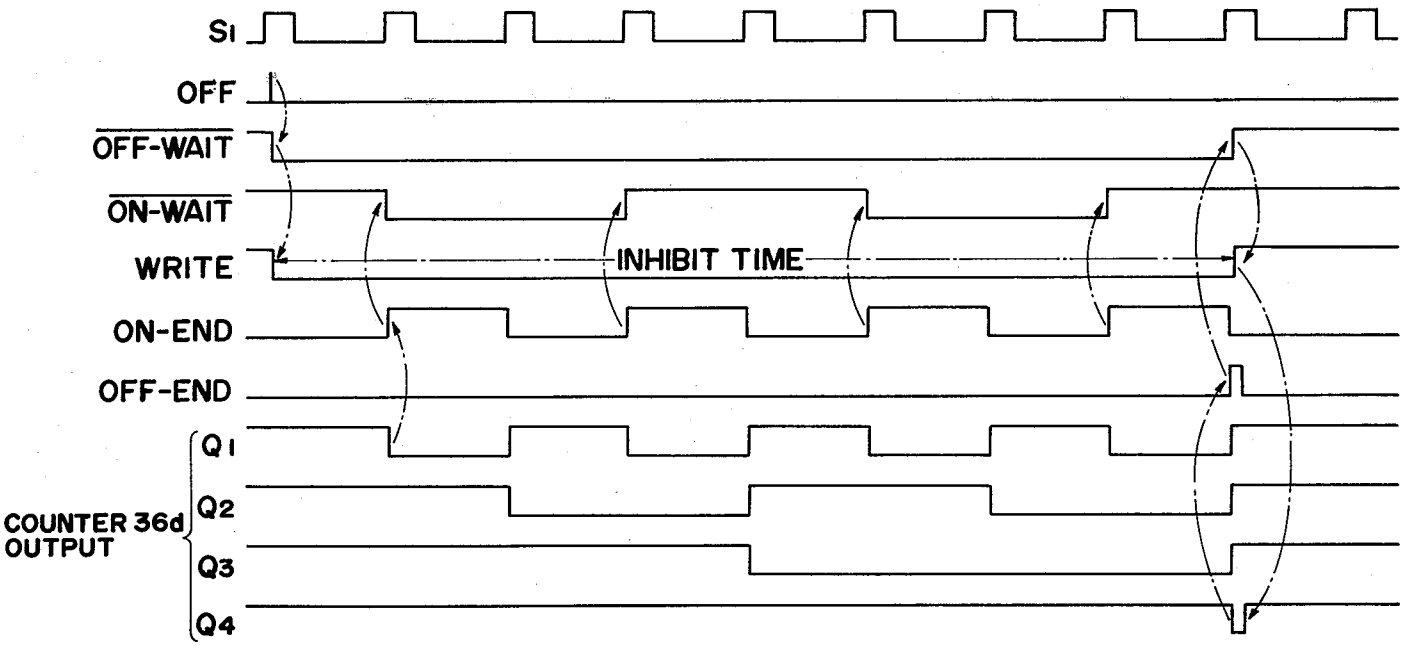
FIG. 23 is a timing diagram which illustrates the operation of the inhibit time generator at the time when a key is released.

Therefore, when the key operation (key depression or key release) of the accompanying keyboard is done, it is detected by the keying detector 35, and the inhibit time generator 36 is controlled by the detection output. Thus, at the key change at which the accompanying key is turned "on" or "off", the operation of the chord/root note write-in pulse generator 33 is ceased for a fixed time so as to prevent the detection of the chord unfavorable for the performance. The keying detector 35, the inhibit time generator 36 and the chord/root note write-in pulse generator 33 are shown in FIG. 22. As apparent from the operating timing diagram (FIG. 21) of the chord detector described before, when the key change takes place, the SIK signal and the SR12 signal become different at the time-division control sequence $S_1$. The key change can accordingly be detected by comparing the SR12 signal and the SIK signal. As illustrated in FIG. 22, in the keying detector 35, the SIK signal and the SR12 signal are respectively entered into AND gates 35*a* and 35*b*, and their inverted outputs owing to inverters 35*c* and 35*d* and also entered into the respective AND gates 35*b* and 35*a*. The signals $S_1$, $\tau_3$ and $\overline{T_{013}}$ are applied to both the AND gates 35*a* and 35*b*. At the key depression operation, a timing at which the SIK signal becomes "1" and the SR12 signal becomes "0" exists, so that an ON pluse is provided from the AND gate 35*a*. Conversely, at the key release operation, a timing at which the SIK signal becomes "0" and the SR12 signal become "1" exists, so that an OFF pulse is provided from the AND gate 35*b*. In the absence of the key change, the outputs of both the AND gates 35*a* and 35*b* hold the "0" state. Such outputs are respectively sent to reset terminals of flip-flops 36*a* and 36*b* of the inhibit time generator 36. Outputs from these flip-flops are entered into an AND gate 36*c*, to form a WRITE signal. On the other hand, the sequence signal $S_1$ is sent to a counter circuit 36*d*, a $Q_1$ output and a $Q_4$ output of which are respectively supplied to the flip-flops 36*a* and 36*b* through inverters. The counter circuit 36*d* is set by the WRITE signal. That is to say, in this embodiment, the WRITE signal is made "0" during one (1) period of the sequence signal $S_1$ at the key depression operation, and over eight (8) periods of the sequence signal $S_1$ at the key release operation. A timing diagram of the inhibit time generator at the time of the key release is given in FIG. 23. The WRITE signal and the chord coincidence signal ACRD from the chord detector 32 are transmitted to a first-stage AND 33*a* of the chord-/root note write-in pulse generator 33. The chord/root note write-in pulse generator 33 is composed of several logic gates and flip-flops. It generates the chord/root note write-in pulse ACD-P by giving a preference to the chord coincidence signal ACRD which arrives first in a period after the time-division control sequence $S_1$. As illustrated in FIG. 22, the WRITE signal controls the passage of the chord coincidence signal ACRD in the AND gate 33*a*. During the fixed inhibit time following the key change, the WRITE signal becomes "0," the chord/root note write-in pulse is not generated, and the stored contents of the chord memory 37 and the accompanying key note memory 58 are not rewritten. Therefore, the unfavorable chord detection is preventable.

Figure 24:
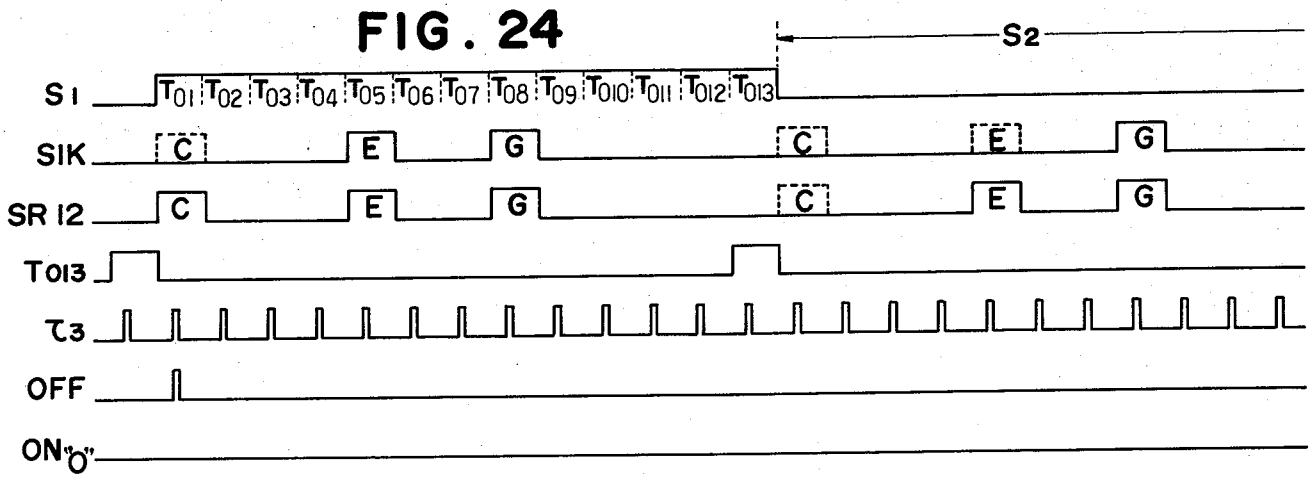
Figure 25:
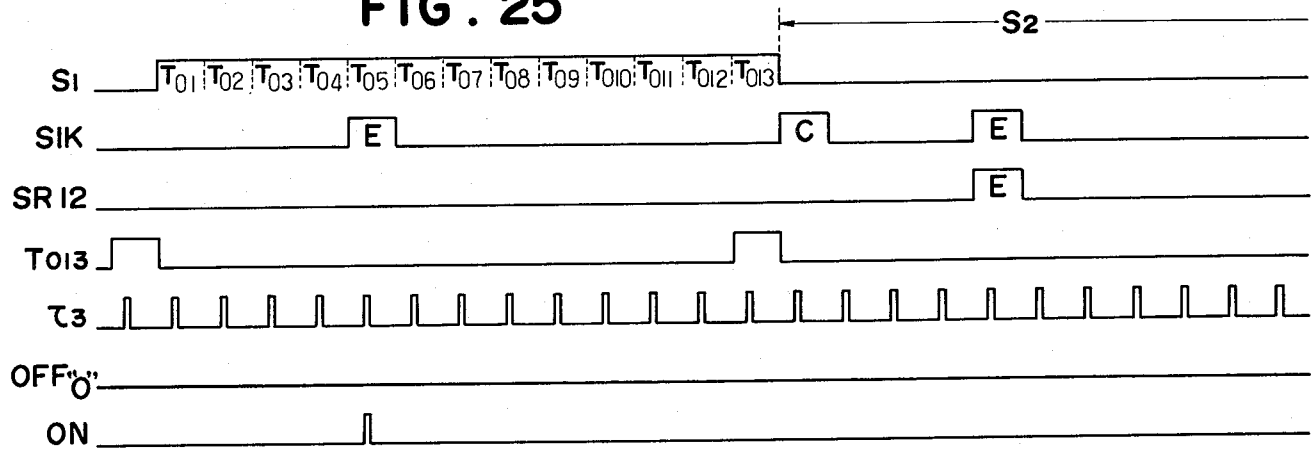

By way of example, let it be supposed that as illustrated in FIG. 24, the key release operations have been done on the accompanying keyboard from a C, E, G (C major chord)-keys depression state to an E, G-keys depression state, a G-key depression state and an all-keys "off" state with some time differences. Then, an OFF pulse arises at the $\tau_3$ timing of $T_{01}$ of the time-division control sequences $S_1$, whereby the WRITE signal becomes "0" for the fixed period. If the OFF signal does not exist, the E minor chord of notes E and G will be detected in the time-division control sequence $S_2$. It is now supposed that when contrariwise keys C, E and G are depressed on the accompanying keyboard so as to assign the C major chord, the key depression operations have been done in the order of E→C and E→C, E, G. Then, as illustrated in FIG. 25, an ON pulse arises at the $\tau_3$ timing of $T_{05}$ of the time-division control sequence $S_1$, whereby the WRITE signal becomes "0" for the fixed period. If the ON signal does not exist, the E minor chord will be detected in the time-division control sequence $S_2$. By establishing the fixed inhibit time in this manner, even when the non-uniformity in the keys is involved at the key depression or key release operation, only the desired root note/chord is detected, and a smooth performance can be achieved.

IX. Generation of Note Assignment Signal for Auto-chord Accompaniment:

In an automatic accompanying apparatus, it is necessary to detect the root note and the type of a chord defined by depressed keys and to generate a note assignment signal (ACC signal) for the execution of an automatic chord accompaniment on the basis of these information. Since the number of the combinations between the root notes and the chord types is very large, the degree of complicacy of the circuit arrangement varies greatly depending on what ACC-signal generation system is adopted.

In this respect, however, ACC signals can be obtained with a simplified circuit arrangement by adopting a construction which is quite different from known constructions and in which are combined a degree signal generator and a ROM (read only memory) storing therein degree names corresponding to chord types.

Figure 26:
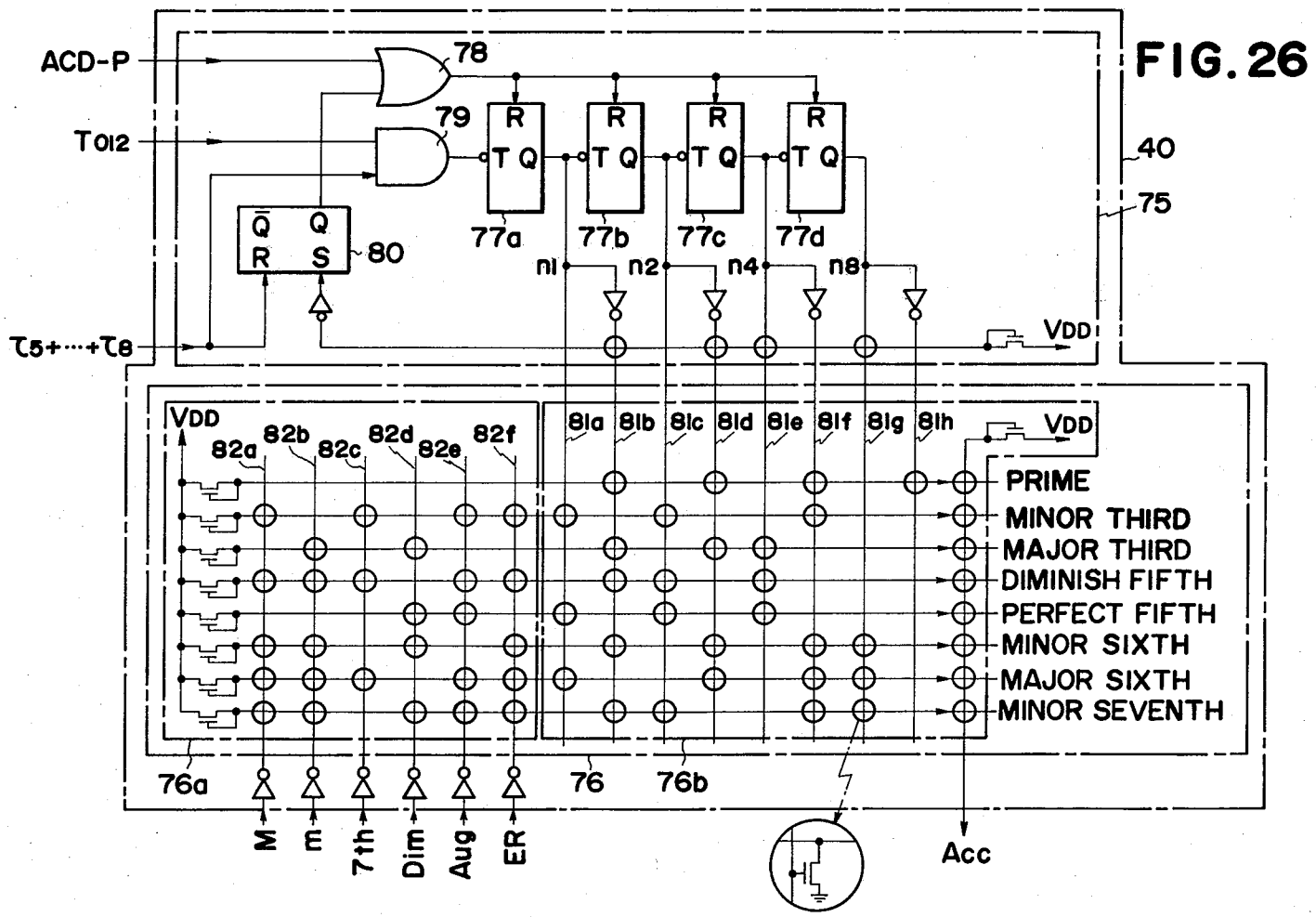

A concrete example of the ACC signal generator 40 is as shown in FIG. 26, and it is made up of a degree signal generator 75 and a ROM 76. The degree signal generator 75 has a counter circuit in which four toggle flip-flops 77*a*, 77*b*, and 77*d* are connected in cascade and which carries out the duodecimal operation, an OR circuit 78 whose output is connected to the reset terminals R of the counter circuit, an AND circuit 79 whose output is connected to the T terminal of the first-stage toggle flip-flop 77*a*, and a set/reset flip-flop 80. The R terminal of the set/reset flip-flop 80 and one input terminal of the AND circuit 79 are supplied with the same timing pulse $\tau_5 + \ldots + \tau_8$ as fed to the note signal generator 51. The other input terminal of the AND circuit 79 is supplied with the inverted timing signal $\overline{T_{012}}$. Further, the OR circuit 78 is supplied with the write pulse signal ACD-P from the chord/root note write-in pulse generator 33 and an oupput signal from the set/reset flip-flop 70.

Figure 27:
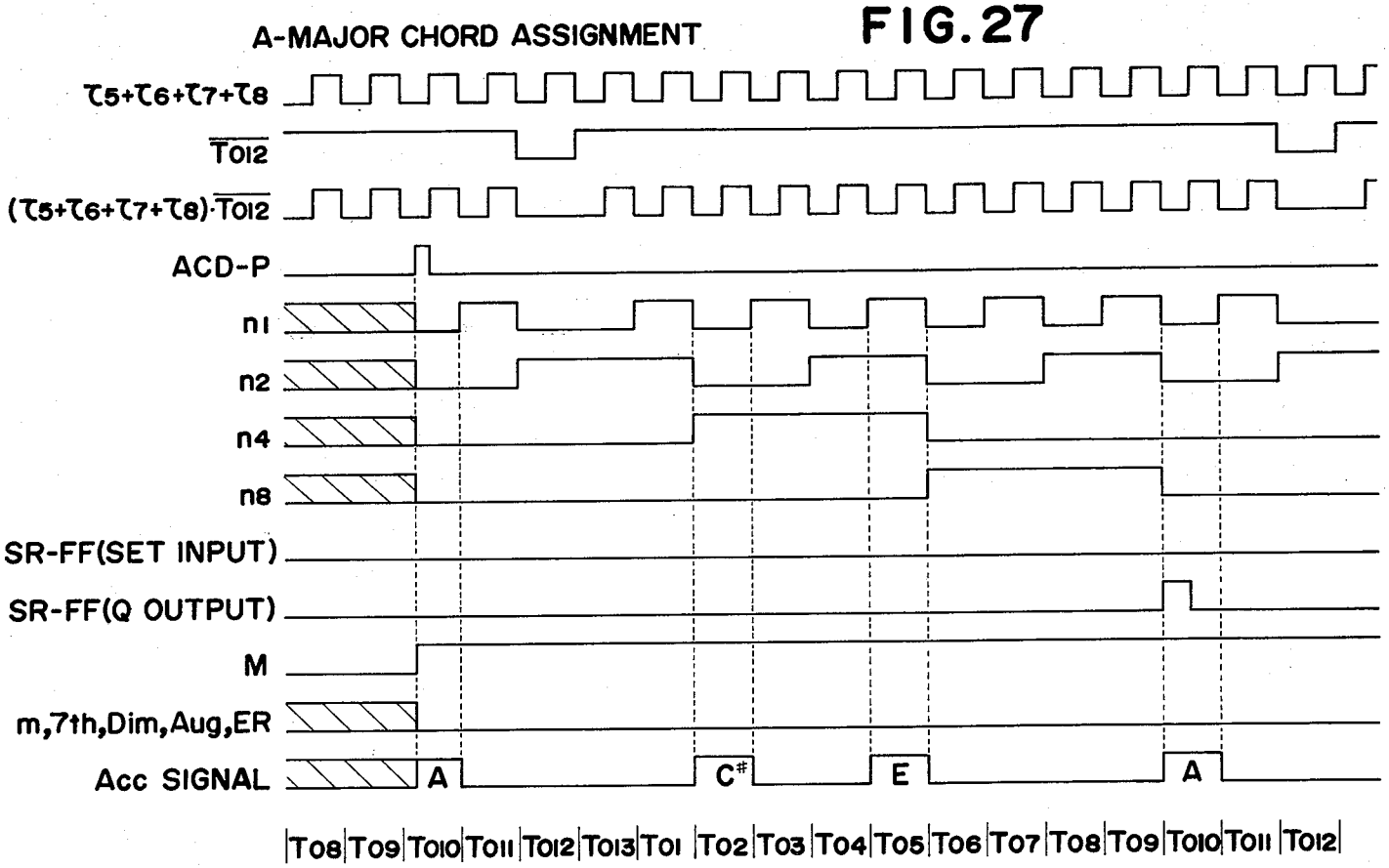

Accordingly, the degree signal generator 75 is reset at the timing of the root note, the internal state of the counter circuit is successively changed at the same timings as the operating timings of the note signal generator 51, and a binary-word degree signal $N_1$, $n_2$, $n_4$, $n_8$ is obtained from Q terminals on the output sides of the respective toggle flip-flops 77*a*, . . . , and 77*d* (refer to FIG. 27).

The ROM 76 has a first ROM portion 76*a* which stores therein degree names corresponding to chord types, and a second ROM portion 76*b* which is joined to the first ROM portion and which decodes the degree signals into signals of timings corresponding to the degree names. The degree signals $n_1$, $n_2$, $n_4$, $n_8$ and their inverted signals are applied to the ROM lines 81*a*, 81*b*; . . . ; and 81*g*, 81*h* of the second ROM portion 76*b*. The chord signals M, m, 7th, . . . , and ER from the decoder 38 are applied to the ROM lines 82*a*, 82*b*; . . . ; and 82*e*, 82*f* of the first ROM portion 76*a*.

The first ROM portion 76*a* has the degree name ROM lines for the assigned chord types selected as indicated in Table 8 below.

Table 8

| Degree name | Chord type: Major (M) | Minor (m) | Seventh (7th) | Diminish (Dim) | Augment (Aug) | Erroneous Key depression (ER) |
|---|---|---|---|---|---|---|
| 1° | ∘ | ∘ | ∘ | ∘ | ∘ | ∘ |
| minor 2° | | | | | | |
| major 2° | | | | | | |
| minor 3° | | ∘ | | ∘ | | |
| major 3° | ∘ | | ∘ | | ∘ | ∘ |
| perfect 4° | | | | | | |
| diminished 5° | | | | ∘ | | |
| perfect 5° | ∘ | ∘ | ∘ | | | ∘ |
| minor 6° | | | | | ∘ | |
| major 6° | | | | ∘ | | |
| minor 7° | | | ∘ | | | |
| major 7° | | | | | | |

Mark '0' indicates the selection of the ROM line. As understood from this table, the degree name of the erroneous key depression is made the same as that of the major chord, so that the degree name of the major chord is also selected in case of the erroneous key depression. The truth table of the degree names is as given in Table 9.

Table 9

| Degree name | Degree signal: $n_8$ | $n_4$ | $n_2$ | $n_1$ |
|---|---|---|---|---|
| 1° | 0 | 0 | 0 | 0 |
| minor 2° | 0 | 0 | 0 | 1 |
| major 2° | 0 | 0 | 1 | 0 |

Table 9-continued

| Degree name | Degree signal $n_8$ | $n_4$ | $n_2$ | $n_1$ |
|---|---|---|---|---|
| minor 3° | 0 | 0 | 1 | 1 |
| major 3° | 0 | 1 | 0 | 0 |
| perfect 4° | 0 | 1 | 0 | 1 |
| diminish 5° | 0 | 1 | 1 | 0 |
| perfect 5° | 0 | 1 | 1 | 1 |
| minor 6° | 1 | 0 | 0 | 0 |
| major 6° | 1 | 0 | 0 | 1 |
| minor 7° | 1 | 0 | 1 | 0 |
| major 7° | 1 | 0 | 1 | 1 |

Now, the operation of such an ACC signal generator circuit 40 will be described more in detail with reference to the operating timing chart of FIG. 27. Let it be supposed that the A major chord has been assigned on the accompanying keyboard. Then, the major M is detected as the chord type and the note A as the root note of the chord by the chord detector 32. Accordingly, only the major signal M in the chord type assigning signal is applied as "1" to the ACC signal generator 40, and the ROM lines of 1°, major 3° and perfect 5° are selected. From the chord/root note write-in pulse generator 33, the write pulse ACD-P is applied at the timing $T_{010}$ corresponding to the note A. Here the timing representative of the note A is $T_{010}$ and deviated from the timing signal $T_9$ in Table 2. This is because the timing signal is delayed by one bit and then waveshaped by means of the timing waveshaping circuit 31. By the write pulse ACD-P applied at such a timing $T_{010}$ corresponding to the note A, the four toggle flip-flops 77*a*, . . . , and 77*d* are reset, and the degree signal $n_1$, $n_2$, $n_4$, $n_8$ is brought into the state of "0", "0", "0", "0". This state corresponds to 1° as seen from Table 9, and the ACC signal is provided. Since this ACC signal issues at the timing $T_{010}$, it represents the note A. Subsequently, the contents of the toggle flip-flops 77*a*, . . . , 77*d* are successively changed by the timing signals ($\tau_5+ \ldots +\tau_8$). $\overline{T_{012}}$. Because of the major chord, the next ACC signal is provided when the degree name is the major 3°, that is, when the degree signal $n_1$, $n_2$, $n_4$, $n_8$ is "0", "0", "0", "0". This signal issues at the timing $T_{02}$, and therefore represents the note C#. Likewise, the next ACC signal is provided when the degree name is the perfect 5°, that is, when the degree signal $n_1$, $n_2$, $n_4$, $n_8$ is "1", "1", "1", "0". This signal issues at the timing $T_{05}$, and therefore represents the note E. In this manner, the signals are generated at the serial timings $T_{010}$, $T_{02}$, $T_{05}$, $T_{010}$, . . . and become the auto-chord note assignment signal of the A major. The process in which the automatic chord accompanying tone is prepared from such ACC signals is as has been stated before.

Let it be supposed that the A minor chord has been assigned in the one-finger mode performance. The chord detector 32 detects the note A as the root note. Because of the one-finger mode playing, the one-finger control signal is impressed on the chord memory 37, and the chord signal CH-1: "0", CH-2: "0", CH-3: "0" representative of the major is delivered. Since the minor chord has been assigned, the major chord is converted into the minor chord by the ACC-m control signal and the minor chord is sent to the ACC signal generator 40. That is, only the minor signal m in the chord type assignment signal is applied "1", and the ROM lines of 1°, minor 3° and perfect 5° are selected. From the chord/root note write-in pulse generator 33, the write pulse ACD-P is impressed at the timing $T_{010}$ corresponding to the note A. Thus, the four toggle flip-flops 77*a*, . . . , and 77*d* are reset, and the degree signal $n_1$, $n_2$, $n_4$, $n_8$ fall into the state of "0", "0", "0", "0". As seen from Table 9, this state corresponds to 1°, and the ACC signal is provided. Since this ACC signal issues at the timing $T_{010}$, it represents the note A. Subsequently, the contents of the toggle flip-flops 77*a*, . . . , and 77*d* are successively changed by the timing signals ($\tau_5+ \ldots +\tau_8$). $\overline{T_{012}}$. On account of the minor chord, the next ACC signal is provided when the degree name is the minor 3°, that is, when the degree signal $n_1$, $n_2$, $n_4$, $n_8$ is "1", "1", "0", "0". This signal issues at the timing $T_{01}$, and therefore represents the note C. Similarly, the next ACC signal is provided when the degree name is the perfect 5°, that is, when the degree signal $n_1$, $n_2$, $n_4$, $n_8$ is "1", "1", "1", "0". This signal issues at the timing $T_{05}$, and therefore represents the note E. In this way, the signals are produced at the serial timings $T_{010}$, $T_{01}$, $T_{05}$, $T_{010}$, . . . , and they become the auto-chord note assignment signal of the A minor.

As thus far described, the ACC signal generator is constructed by combining the degree signal generator and the ROM, so that the circuit arrangement is conspicuously simplified and that the auto-chord accompaniment of many chord types are possible even in case of the one-finger mode playing.

X. Switching between Automatic Bass Accompaniment and Pedal Bass Accompaniment:

A chord is assinged by actuating an accompanying keyboard, and a chord performance is effected on the basis of the chord type signal. It is usually possible to carry out an automatic bass accompaniment in conformity with a chord name simultaneously detected or to carry out a bass accompaniment by assigning a bass tone on a pedal keyboard. In this case, it is preferable that a player can freely select whether the automatic bass accompaniment is to be made or the bass accompaniment as the player intends is to be made. To this end, the ATK signal for controlling the generation of the automatic bass tone is utilized for a pedal bass/automatic bass switching assignment signal, whereby the mutual switching between the automatic bass accompaniment and the pedal bass accompaniment can be effected with a preference given to the pedal bass. However, if the pedal bass accompaniment is switched to the automatic bass accompaniment as soon as the release of a pedal key in the period in which the ATK signal exists, the bass accompaniment will become discontinuous, which leads to a musically unfavorable result.

Figure 28:
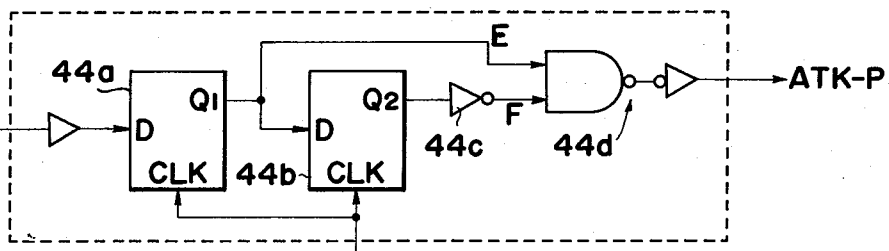
Figure 29:
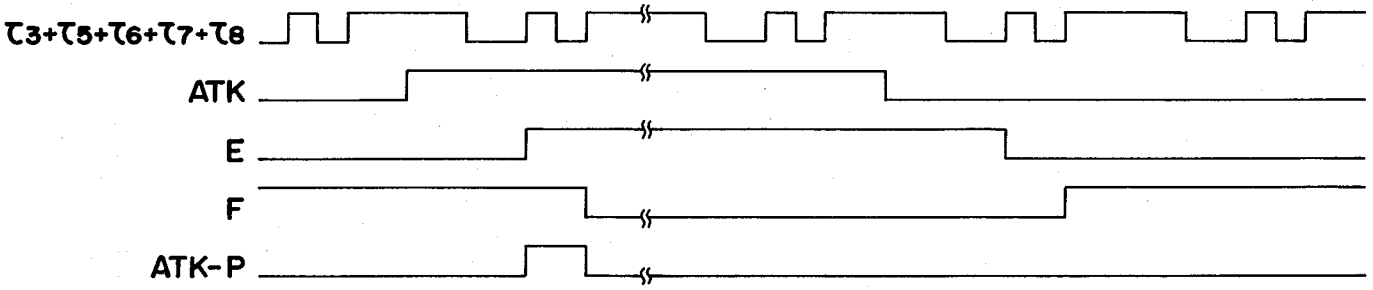

As shown in FIG. 28, the ATK pulse generator circuit 44 can be constructed of two flip-flops and several logic gates. The operating timing diagram of the circuit 44 is illustrated in FIG. 29. The bass/auto-bass switching assignment signal (attack signal) "atk" transmitted from the bass pattern assignment circuit 7 and the timing pulse $\tau_3+\tau_5+ \ldots +\tau_8$ are sent to the flip-flop 44*a*, to provide an output E. The output E and the above-mentioned timing pulses are sent to the other flip-flop 44*b*, and an inverted output F owing to the inverter 44*c* is obtained. These outputs E and F are sent to the NAND gate 44*d*, an output of which becomes the ATK-P signal. As apparent from FIG. 29, the ATK-P signal is a narrowed pulse formed at a certain timing in the vicinity of the leading edge of the attack signal ATK. The pulse generator 44 need not necessarily be such a combination of logical circuits. For example, when it is constructed of a well-known differentiation circuit, it is possible to obtain an ATK-P signal which is narrowed at the timing of the leading edge of the attack signal ATK.

Figure 30:
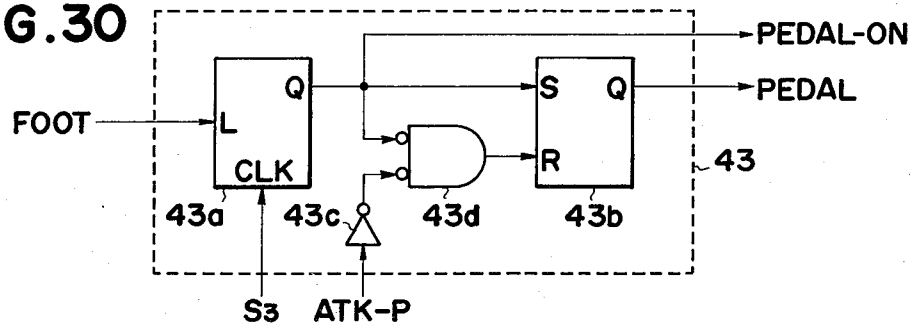

As shown in FIG. 30, the pedal/auto-bass switching signal generator circuit 43 can be constructed of two flip-flops and two logical circuits. The pedal key depression signal FOOT is sent to the flip-flop 43*a*, and stored at the timing of the time-division control sequence signal $S_3$. The Q output of the flip-flop 43*a* is directly used as the PEDAL-ON signal indicative of the depression of the pedal key, and is also sent to the S terminal of the SR flip-flop 43*b*. The ATK-P signal from the ATK pulse generator 44 is passed through the inverter 43*c*, and the inverted output is sent to the gate 43*d* together with the Q output of the flip-flop 43*a*, so that the SR flip-flop 43*b* is reset. The Q output of the SR flip-flop 43*b* becomes the PEDAL signal for the switching between the pedal bass accompaniment and the automatic bass accompaniment.

Figure 31:
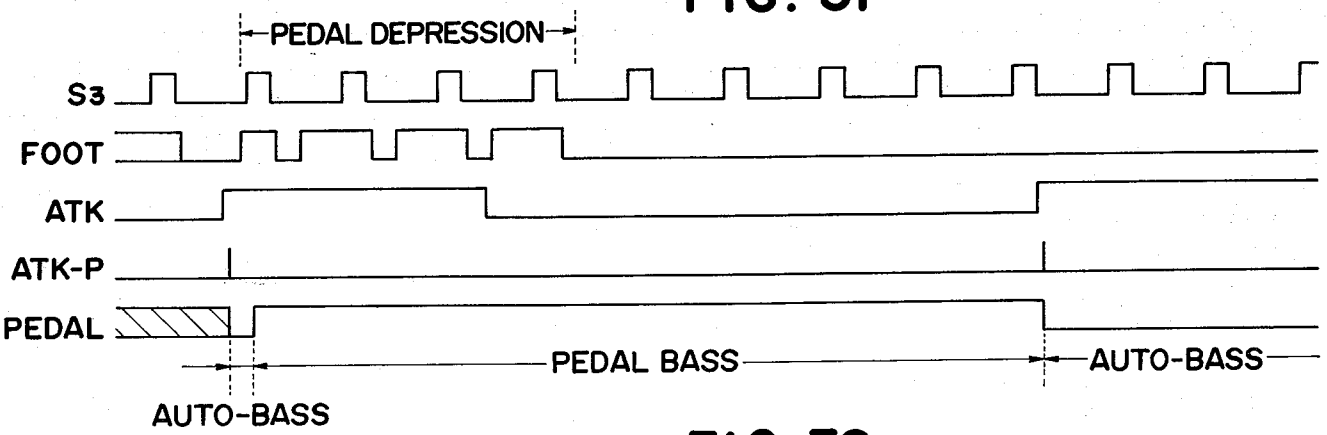
Figure 32:
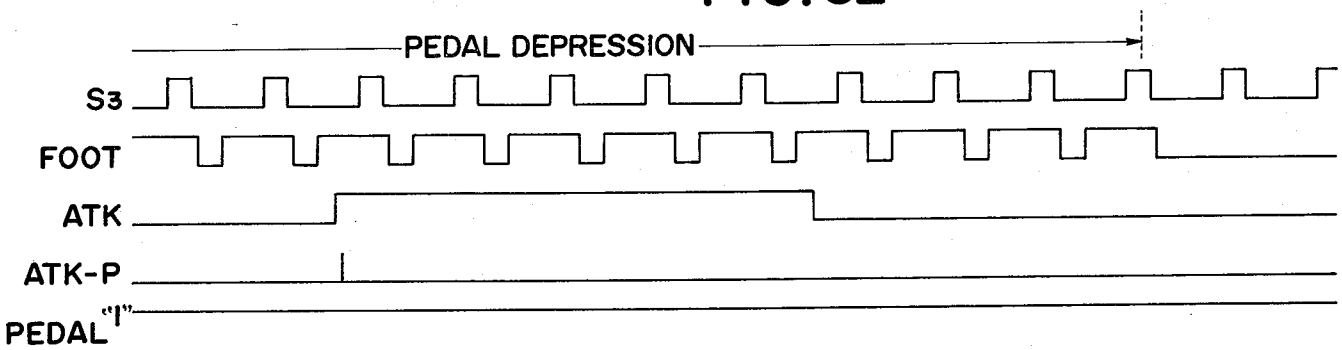

The operating timing charts of the pedal/auto-bass switching signal generator 43 are illustrated in FIGS. 31 and 32. As apparent from FIG. 31, when the attack signal ATK enters in the absence of any key depression on the pedal keyboard, that is, in the period in which the pedal key depression signal ROOT is "0", the SR flip-flop 43*b* is reset by the ATK-P signal formed of the leading edge thereof or the vicinity to the leading edge thereof. The PEDAL signal becomes "0", and the automatic bass accompaniment is effected. When the pedal key depression signal FOOT enters, the Q output of the flip-flop 43*a* becomes "1" at the timing of the time-division control sequence signal $S_3$, to issue the PEDAL-ON signal and also to set the SR flip-flop 43*b*. The PEDAL signal becomes "1", and the automatic bass accompaniment is switched to the pedal bass accompaniment. The "1" output for assigning the pedal bass accompaniment continues until the pedal key depression signal FOOT disappears and the following ATK-P signal enters to reset the flip-flop 43*b*. That is to say, the pedal bass accompaniment starts at the timing of the time-division control sequence signal $S_3$ at the time of the depression of the pedal key, and it ends at the timing of the ATK-P signal which arrives first after the release of the pedal key. In any period other than the period of the pedal base accompaniment, the automatic bass accompaniment is effected. As illustrated in FIG. 32, even in the presence of the ATK-P signal, the output of the flip-flop 43*b* continues to maintain the "1" state as long as the pedal key depression signal FOOT exists or is "1", so that the pedal bass accompaniment is continued during such a period. In this way, the automatic bass accompaniment is always initiated at the fixed timing irrespective of the pedal key actuation, and it is never initiated at any halfway timing, so that a smooth and musically favorable bass accompaniment can be effected.

The PEDAL signal thus obtained is sent to the pedal-/auto-bass switching circuit 59 and the divide-by-13 correction circuit 61.

As described above, the automatic accompaniment is carried out by the automatic accompanying circuit and the peripheral circuits connected thereto, and the chord name which the performer has assigned on the accompanying keyboard can be detected. That is, the key depression signals indicative of the key notes which the performer has actuated by the keyboard operations are stored in the shift register, and while cyclically shifting the stored contents of the shift register, they are directly compared with the ROM storing therein the basic forms of chord names (e.g., various C chords), whereby the binary word reprsentative of the corresponding chord type is directly read out from the second ROM connected to the coincident ROM line, and besides, the root note of the chord is detected from the number of shifts till the read-out of the chord type. Therefore, the circuit arrangement is simplified. Moreover, the type and the root note of the chord can be detected in one shift cycle of the shift register, which shortens the detecting time and enhances the key response rate.

Though the present has been described with reference to the preferred embodiments thereof, many modifications and alterations may be made within the spirit of the present invention.

What is claimed is:

1. A keyboard type automatic accompanying system comprising:

accompanying keyboard means for providing key depression signals corresponding to notes of depressed keys, root note/chord detection means including in combination a shift register with all flip-flop outputs available, which stores said key depression signals and which cyclically shifts the stored contents, and a read only memory device which stores basic forms of chord names and types of chords therein, the parallel outputs of said shift register being applied to said read only memory device so as to detect a root note of a chord to-be-played and a type thereof, tone signal production means for generating bass and accompaniment tone signals from the detected signal indicative of the root note or indicative of the root note as well as the chord type, and output means for amplifying said tone signal and driving a loudspeaker, wherein said read only memory device comprises (a) a first read only memory for storing basic forms of chord names and directly comparing cyclically the shifted contents of said shift register with the stored contents of said first read only memory and detecting a coincident chord name, (b) a second read only memory storing therein binary information representative of the type of chords, said binary information being directly read out by the coincident output of said first read only memory, (c) an erroneous chord detection ROM line for detecting a binary information representative of an erroneous chord as one of the binary information representative of the type of chords and one of notes assigned by key depression as a root note, said erroneous chord detection ROM line being activated when any one of the parallel outputs of said shift register is "1" and in a sequence period subsequent to the chord detection sequence period, and (d) a one-finger control line disposed in said read only memory device along parallel output lines of said shift register, thereby ceasing the operation of chord type detection in case of a one-finger chord playing mode and executing only the detection of the erroneous chord to detect the note assigned by key depression.

2. The keyboard type automatic accompanying system according to claim 1, wherein said root note/chord detection means includes a shift/write switching circuit, with which said key depression signals are written into said shift register in a period of a certain time-division control sequence and said stored contents of said shift register are cyclically shifted in any other period.

3. The keyboard type automatic accompanying system according to claim 1, wherein said shift register of said root note/chord detection means is a serial input type one of 12 bits, and said key depression signals are entered into said shift register at serial timings.

4. The keyboard type automatic accompanying system according to claim 1, wherein said first read only memory has a memory cell structure in which a plurality of sorts of shift register parallel outpput patterns are coincident for at least one ROM line of said read only memory, whereby many sorts of chords can be stored by the use of a read only memory of small memory capacity.

5. The keyboard type automatic accompanying system according to claim 1, wherein said read only memory device has an accompanying keys ALL-OFF detecting ROM line which is activated when all the parallel outputs of said shift register are "0", whereby whether the accompanying keyboard is in a key depression state or a key release state can be detected at all times.

6. The keyboard type automatic accompanying system according to claim 1, further comprising root note memory means for storing binary information representative of root notes of chords.

7. The keyboard type automatic accompanying system according to claim 6, further comprising chord memory means for storing binary information representative of types of chords.

8. The keyboard type automatic accompanying system according to claim 7, further comprising a keying detector which detects a change of a key signal due to a key releasing or key depressing operation on the accompanying keyboard, and an inhibit time generator which generates a predetermined inhibit time on the basis of the detected signal, whereby the root note memory circuit and the chord memory circuit are inhibited from storing the detection output from said root note/chord detection means over the predetermined time at the key change.

9. The keyboard type automatic accompanying system according to claim 8, wherein the inhibit time which is generated by said inhibit time generator is shorter at the key depressing operation than at the key releasing operation.

10. The keyboard type automatic accompanying system according to claim 7, wherein said tone signal production means includes ACC signal generation means for preparing an auto-chord note assignment signal from the binary information representative of the root note of the chord and the type thereof, rhythm pulse generation means for generating rhythm pulses in accordance with a predetermined rhythm of a selected music, and chord tone generation means for generating an automatic chord accompaniment tone signal by taking timings of said auto-chord note assignment signal with said rhythm pulses.

11. The keyboard type automatic accompanying system according to claim 10, wherein said ACC signal generation means includes a degree signal generator circuit which generates a degree signal of a binary word corresponding to a degree name, and a read only memory which stores therein the degree names corresponding to the chord types, from which the stored content is read out by a signal indicative of the chord type and which controls the output of said degree signal generator circuit.

12. The keyboard type automatic accompanying system according to claim 11, wherein said read only memory of said ACC signal generation means includes a first read only memory portion which stores therein the degree names corresponding to the chord types and which is read out by a chord signal, and a second read only memory portion which is coupled to said first read only memory portion and said degree signal generator circuit and which converts the degree signals changing successively, into the auto-chord note assignment signals of serial timings corresponding to the degree names.

13. The keyboard type automatic accompanying system according to claim 12, wherein said first read only memory portion has a ROM line which stores therein the same degree name as that of the major chord for an undetectable erroneous chord, the stored content being read out by a signal which indicates the chord type significant of the erroneous chord.

14. The keyboard type automatic accompanying system according to claim 11, further comprising chord type assignment signal-conversion means provided with ACC-m and 7th control circuit, so that the signal indicative of the chord type from said chord detection means is forcibly converted into the signal indicative of the major chord by the one-finger control signal, whereupon the obtained signal is converted into the minor or seventh chord by various control signals.

15. The keyboard type automatic accompanying system according to claim 1, wherein said tone signal production means is bass tone production means for generating, as a bass tone signal, one of the notes assigned by the key depression.

16. The keyboard type automatic accompanying system according to 7, wherein said tone signal production means further includes means for providing binary information representative of a note for automatic bass accompaniment of the assigned chord name, on the basis of the binary information indicative of the root note and the type of the type of the chord, and bass tone production means for generating an automatic bass tone signal in response to the provided output.

17. The keyboard type automatic accompanying system according to claim 16, further comprising a pedal keyboard, a circuit which detects a pedal key note assigned by a depressing operation of said pedal keyboard, a bass tone generator circuit which generates a pedal bass tone in response to the detected pedal key note, and a bass tone switching signal generator circuit which selects one of the automatic bass tone and the pedal bass tone to be provided.

18. The keyboard type automatic accompanying system according to claim 17, wherein said bass tone switching signal generator circuit includes an ATK-P signal generator circuit which narrows a generating timing signal ATK of the automatic bass accompaniment at a position of a leading edge thereof or a part close to the leading edge thereof and which provides the narrowed signal as an ATK-P signal, and a pedal-/auto-bass switching signal generator circuit which receives said ATK-P signal and a pedal keys signal FOOT from said pedal keyboard as inputs thereof, so that only in the absence of said pedal key signal FOOT, a switching signal to the automatic bass accompaniment is generated in synchronism with the narrowed ATK-P signal.

* * * * *